US007156060B2

(12) United States Patent
Oshita et al.

(10) Patent No.: US 7,156,060 B2
(45) Date of Patent: Jan. 2, 2007

(54) CAM DRIVE GEAR AND VALVE OPERATING SYSTEM DRIVE GEAR FOR ENGINE

(75) Inventors: Toru Oshita, Wako-hi (JP); Toru Kisaichi, Wako (JP); Shingo Nakayama, Wako (JP); Atsushi Sawa, Wako (JP); Ryushi Tsubota, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/295,098

(22) Filed: Dec. 6, 2005

(65) Prior Publication Data

US 2006/0137636 A1 Jun. 29, 2006

(30) Foreign Application Priority Data

Dec. 28, 2004 (JP) ..... 2004-380363
Jan. 28, 2005 (JP) ..... 2005-022109

(51) Int. Cl.
*F01L 1/02* (2006.01)

(52) U.S. Cl. ..... 123/90.31; 123/90.17; 123/90.27

(58) Field of Classification Search ..... 123/90.15, 123/90.16, 90.17, 90.18, 90.27, 90.31
See application file for complete search history.

(56) References Cited

U.S. PATENT DOCUMENTS 4,395,980 A 8/1983 Tominaga et al.
4,589,382 A * 5/1986 Tsuboi ..... 123/90.31
4,633,826 A 1/1987 Tominaga et al.
4,637,354 A 1/1987 Tominaga et al.
5,063,895 A 11/1991 Ampferer
5,740,773 A 4/1998 Ohshige
6,412,464 B1 7/2002 Schneider et al.

FOREIGN PATENT DOCUMENTS

EP 0 656 464 6/1995
GB 248 961 5/1925
JP 5901612 A * 1/1984
JP 4-75364 11/1992
JP 9-250354 9/1997

* cited by examiner

*Primary Examiner*—Ching Chang
(74) *Attorney, Agent, or Firm*—Hamre, Schumann, Mueller & Larson, PC

(57) ABSTRACT

A cam drive gear for an engine is described where the distance between the axes of a crankshaft and an idle shaft bearing an idle gear thereon can be made smaller, thereby contributing to a reduction in the size of the engine. In addition, a valve-operating system drive gear for an engine is also described where it is possible to restrain a cam chain from chattering at its portion wrapped around a drive sprocket.

11 Claims, 15 Drawing Sheets

CAM DRIVE GEAR AND VALVE OPERATING SYSTEM DRIVE GEAR FOR ENGINE

This application claims priority under 35 U.S.C. § 119 to Japanese Patent Application Nos. 2004-380363 and 2005-022109, filed on Dec. 28, 2004 and Jan. 28, 2005 respectively.

FIELD

The present invention relates to a drive gear for an engine, for example a cam drive gear and a valve-operating system drive gear.

BACKGROUND

A cam drive gear for an engine is disclosed in Japanese Patent No. 3309700 in which a primary drive gear provided on a crankshaft is meshed with an idle gear rotatably borne on an idle shaft provided on an engine main body while having an axis parallel to the crankshaft, and drive sprockets are rotated together with the idle gear.

The primary drive gear provided on the crankshaft is formed with a comparatively large diameter so as to transmit rotational torque of the engine to the transmission side. In the cam drive gear disclosed in Japanese Patent No. 3309700, the primary drive gear with the comparatively large diameter is meshed with the idle gear, so that it is necessary for the distance between the axes of the crankshaft and the idle shaft rotatably supporting the idle gear to be set comparatively large, leading to an increase in the size of the engine.

In addition, a valve-operating system drive gear for an engine is disclosed in Japanese Patent Publication No. Hei 4-75364. The valve-operating system drive gear includes a driven sprocket provided on a camshaft rotatably borne on a cylinder head, a drive sprocket operated in conjunction with the rotation of a crankshaft, an endless form cam chain wrapped around the drive sprocket and the driven sprocket, and a chain guide member making sliding contact with the outer periphery of the cam chain. The chain guide member makes sliding contact with the outer periphery of the cam chain so as to restrain the cam chain from chattering between the drive sprocket and the driven sprocket.

In the valve-operating system drive gear disclosed in Japanese Patent Publication No. Hei 4-75364, both end portions of the chain guide member are curved so as to be spaced from the drive sprocket and the driven sprocket. However, the cam chain may chatter at its portions wrapped around the sprockets due to, for example, elongation of the cam chain or wear of the cam chain or of the drive sprocket and the driven sprocket. Such a chattering of the cam chain may occur at the portion of the cam chain wrapped around the drive sprocket due to the weight of the cam chain itself.

BRIEF SUMMARY

A cam drive gear for an engine is described where the distance between the axes of a crankshaft and an idle shaft bearing an idle gear thereon can be made smaller, thereby contributing to a reduction in the size of the engine.

In addition, a valve-operating system drive gear for an engine is also described where it is possible to restrain a cam chain from chattering at its portion wrapped around a drive sprocket.

In one exemplary embodiment, a cam drive gear for an engine includes an idle gear rotatably borne on an idle shaft supported on an engine main body so as to permit power to be transmitted from a crankshaft, drive sprockets rotatable together with the idle gear, driven sprockets provided on camshafts, and endless form power transmission members wrapped around the drive sprockets and the driven sprockets. The crankshaft is provided with a primary drive gear for transmitting the power of the engine to a transmission. An idler drive gear having a diameter smaller than a diameter of the primary drive gear is disposed to an outer side of the primary drive gear in the axial direction. The idle gear is meshed with the idler drive gear and the idle shaft has an axis parallel to the crankshaft. The drive sprockets have at least parts of outer peripheries thereof opposed to the primary drive gear and the drive sprockets are disposed to an inner side of the idle gear in the axial direction and the drive sprockets are coaxial with and adjacent to the idle gear.

With this exemplary construction, it is possible to reduce the distance between the axes of the crankshaft and the idle shaft, thereby contributing to a reduction in the size of the engine.

In another exemplary embodiment, a primary driven gear is meshable with the primary drive gear, and the primary driven gear is connected to a clutch disposed at a position opposed to the outer periphery of the idler drive gear and interposed between the crankshaft and the transmission. As a result, it is possible for the clutch between the crankshaft and the transmission to be laid out close to the crankshaft side, to reduce the distance between the axis of the clutch and the axis of the crankshaft, thereby further contributing to the reduction in the size of the engine.

In a further exemplary embodiment, the drive sprockets, the driven sprockets and the power transmission members comprise a pair of banks that are arranged in a V-shape adjacent to a crankcase that rotatably supports the crankshaft thereon. The banks are mutually adjacently disposed toward one end of the crankshaft, and the drive sprockets of both of the banks are formed integral with the idle gear. This construction permits a reduction in the size of the engine in a direction along the axis of the crankshaft, and it is possible to achieve a reduction in the number of engine component parts by forming the drive sprockets of both of the banks to be integral with the idle gear.

In another embodiment, the idle shaft has an eccentric shaft portion, and the idle shaft is supported on the engine main body so as to permit regulation of the position of the idle shaft about an axis set off from the axis of the eccentric shaft portion. The idle gear is rotatably borne on the eccentric shaft portion through a needle bearing. This construction prevents the drive sprockets and the idle gear from being enlarged in size, and allows a further reduction in the distance between the axes of the idle shaft and the crankshaft, while making it possible to reduce the backlash between the idler drive gear and the idle gear by regulating the rotational axis of the idle gear.

In another embodiment, a valve-operating system drive gear for an engine includes a driven sprocket provided on a camshaft that is rotatably borne on a cylinder head, a drive sprocket operated in conjunction with the rotation of a crankshaft, an endless form cam chain wrapped around the drive sprocket and the driven sprocket, and a chain guide member making sliding contact with the outer periphery of the cam chain. An end portion of the chain guide member adjacent the drive sprocket is so formed as to cover, from the outside, at least a portion of the outer periphery of the drive sprocket around which the cam chain is wrapped.

With this construction of the valve-operating system drive gear, the cam chain can be restrained from chattering at its portion wrapped around the drive sprocket, and the cam chain can be stably guided by the chain guide member. Moreover, the end portion can maintain the wrapped condition of the cam chain around the drive sprocket so as to prevent the cam chain from slipping off from the drive sprocket, at the time of mounting the valve-operating system drive gear, thereby enhancing the mountability.

The end portion of the chain guide member can be formed as to extend around to the lower side of the drive sprocket and is supported by a support member fastened to an engine main body that includes the cylinder head. Therefore, the cam chain can be covered, at its portion wrapped around the drive sprocket, by the end portion of the chain guide member over a wider range, and the end portion of the chain guide member is supported by the engine main body through the support member in the vicinity of the drive sprocket. Therefore, it is possible to restrain more effectively the cam chain from chattering at its portion wrapped around the drive sprocket.

In another embodiment, a valve-operating system drive gear for an engine includes first and second power transmission means each including a driven sprocket provided on a camshaft that is rotatably borne on a cylinder head, a drive sprocket operated in conjunction with the rotation of a crankshaft, an endless form cam chain wrapped around the drive sprocket and the driven sprocket, and a chain guide member making sliding contact with the outer periphery of the cam chain. The first and second power transmission means are disposed respectively in first and second banks arranged in a V shape, with the drive sprockets in both of the banks being arranged coaxially. In addition, in the power transmission means on at least one side of the first and second banks, an end portion of the chain guide member adjacent the drive sprocket is so formed as to cover, from the outside, at least a portion of the outer periphery of the drive sprocket around which the cam chain is wrapped.

With this construction of the valve-operating system drive gear, even in the V-type engine in which the cam chains are liable to chatter because the cam chains are wrapped respectively around the sprockets disposed coaxially in correspondence with both banks, it is possible to restrain the cam chain from chattering at the portion wrapped around the sprocket, in at least one of the banks, and the cam chain can be stably guided by the chain guide member. Moreover, the end portion on the drive sprocket side of the chain guide member can maintain the wrapped condition of the cam chain around the drive sprocket so as to prevent the cam chain from slipping off from the drive sprocket at the time of mounting the valve-operating system drive gear, thereby enhancing the mountability.

The end portion of the chain guide member can be so formed as to extend around to the lower side of the drive sprocket of the power transmission means of the one bank and can be astride the cam chain of the power transmission means of the other bank. Further, the end portion can be supported by a support member fastened to an engine main body that includes the cylinder heads. Therefore, the cam chain can be covered, at its portion wrapped around the drive sprocket, by the end portion of the chain guide member over a wider range, and the end portion of the chain guide member in one of the banks is supported by the engine main body through the support member in the vicinity of the drive sprocket. Therefore, it is possible to more effectively restrain the cam chain from chattering at its portion wrapped around the drive sprocket.

In addition, the end portion of the chain guide member and a support portion connected to the chain guide member of the power transmission means of the other of the banks are laid on each other and are supported by the support member and a support boss provided on the engine main body for fastening the support member. Since the chain guide members in both banks are each supported in the vicinity of the drive sprocket by the support member and the support boss on the engine main body side for fastening the support member, it is possible to reduce the number of component parts, and, at the time of mounting and at the time of disassembly for maintenance or the like, the mounting and dismounting of the chain guides in both banks are facilitated, leading to labor saving.

Further, the drive sprockets can be provided adjacent a rotary member having an axis parallel to the crankshaft and which is rotated in conjunction with the crankshaft. Since the rotary member is arranged in a location rich in spatial allowance, the shapes of the chain guide members can be freely set without being influenced by the layout. Moreover, as compared with the case where the drive sprockets are provided on the crankshaft, the drive sprockets can be made smaller, and the portions of the cam chains wrapped around the drive sprockets can be covered by the end portions of the chain guide members over a wider range, while avoiding an increase in the size of the end portions on the drive sprocket side of the chain guide members.

DETAILED DESCRIPTION

Figure 1:
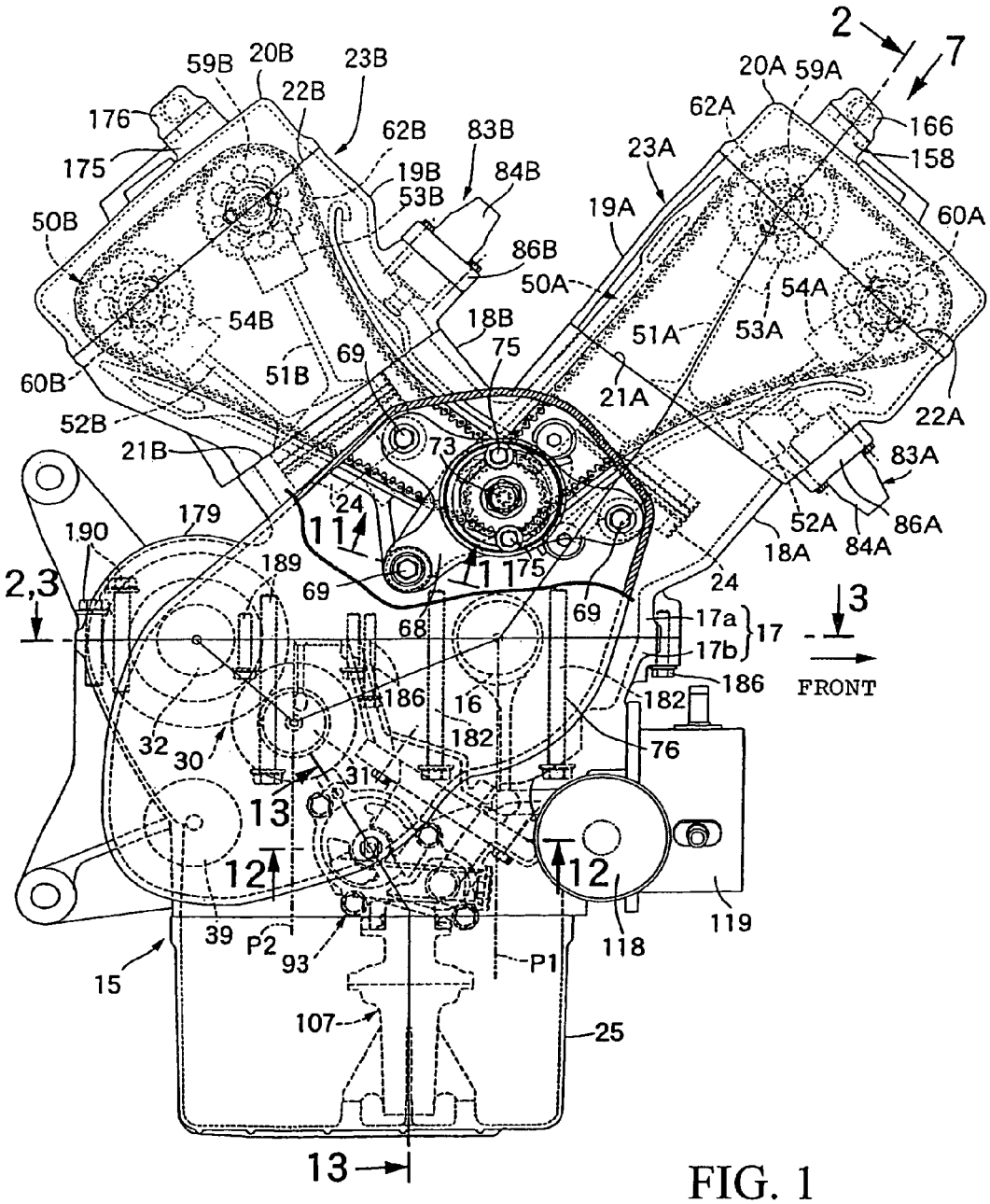
FIG. 1 is a partly cut-out side view of a V-type engine.

In FIG. 1, a five-cylinder V-type engine, for example, is shown mounted on a vehicle or a motorcycle. An engine main body 15 of the engine includes a crankcase 17 rotatably bearing a crankshaft 16 having an axis extending in the left-right direction of the motorcycle, a first cylinder block 18A connected to the crankcase 17 on the front side along the running direction of the motorcycle, a first cylinder head 19A connected to a top connection surface 21A of the first cylinder block 18A, a first head cover 20A connected to a top connection surface 22A of the first cylinder head 19A, a second cylinder block 18B connected to the crankcase 17 on the rear side along the running direction of the motorcycle, a second cylinder head 19*b* connected to a top connection surface 21B of the second cylinder block 18B, and a second head cover 20B connected to a top connection surface 22B of the second cylinder head 19B.

The crankcase 17 includes an upper case 17*a* and a lower case 17*b* connected to each other, and the crankshaft 16 is rotatably borne between the upper case 17*a* and the lower case 17*b*. In addition, the first and second cylinder blocks 18A, 18B are formed integrally with the upper case 17*a*.

A three-cylinder first bank 23A is provided adjacently to the crankcase 17 in the state of being inclined so as to become higher toward the front side with respect to the running direction of the motorcycle. The first bank 23A is composed of a first cylinder block 18A, a first cylinder head 19A and a first head cover 20A. A two-cylinder second bank 23B is provided adjacently to the crankcase 17 on the rear side of the first bank 23A so as to form, together with the first bank 23A, a V shape opening to the upper side. The second bank 23B is composed of a second cylinder block 18B, a second cylinder head 19B and a second head cover 20B.

Figure 2:
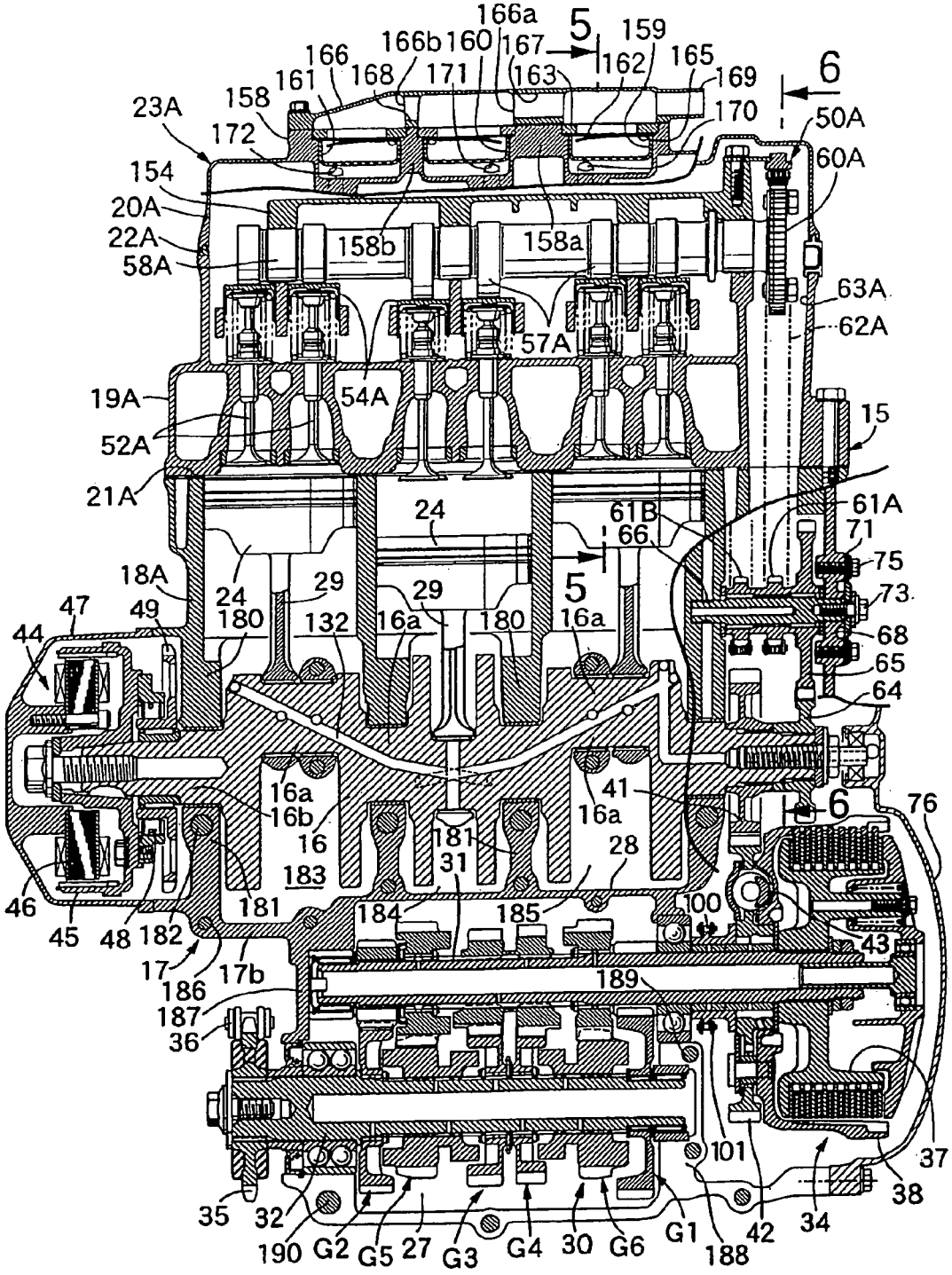
FIG. 2 is a sectional view along line 2—2 of FIG. 1.

Referring to FIG. 2 also, three pistons 24 . . . aligned in a direction along the axis of the crankshaft 16 are slidably fitted in the first cylinder block 18A of the first bank 23A, while two pistons 24 . . . aligned in a direction along the axis of the crankshaft 16 are slidably fitted in the second cylinder block 18B of the second bank 23B, and the pistons 24 . . . of both of the banks 23A and 23B are connected in common to crank pins 16*a* . . . possessed by the crankshaft 16 through connecting rods 29. . . .

Figure 3:
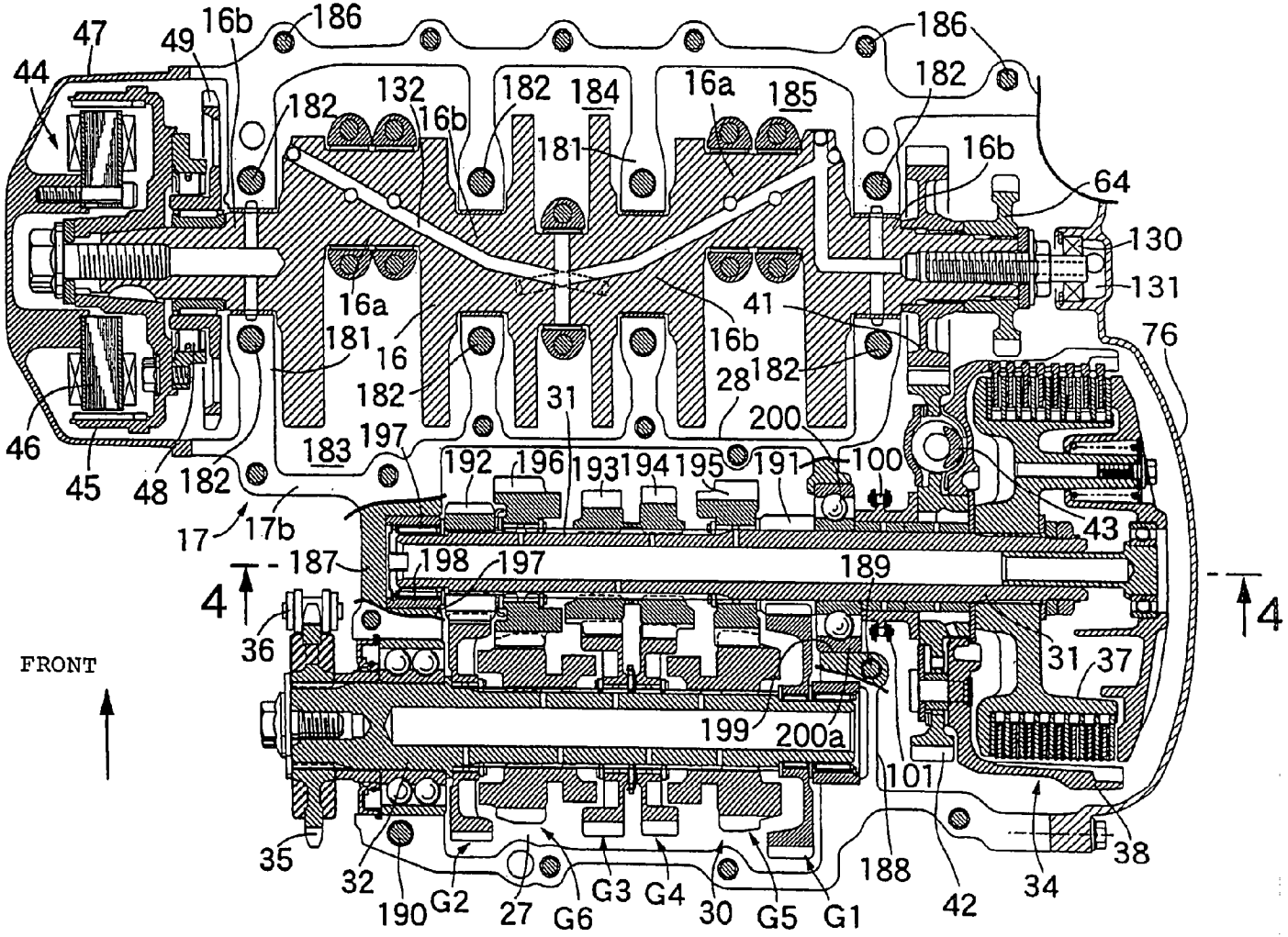
FIG. 3 is a sectional view along line 3—3 of FIG. 1.

Referring to FIGS. 1–3, the upper case 17*a* is integrally provided with four upper journal walls 180, 180 . . . disposed at intervals in the axial direction of the crankshaft 16, and the lower case 17*b* is integrally provided with four lower journal walls 181, 181 . . . corresponding individually to the upper journal walls 180, 180. . . . Four journal portions 16*b*, 16*b* . . . of the crankshaft 16 are rotatably borne between the upper journal walls 180, 180 . . . and the lower journal walls 181, 181 . . . , and the upper journal walls 180, 180 . . . and the lower journal walls 181, 181 . . . are connected to each other by pairs of connecting bolts 182, 182 . . . disposed on both sides of the journal portions 16*b*, 16*b*. . . . Moreover, the connecting bolts 182, 182 . . . are passed through the lower case 17*b* from the lower side and screw engaged with the upper case 17*a*.

With the upper journal walls 180, 180 . . . and the lower journal walls 181, 181 . . . connected to each other, a first crank chamber 183 corresponding to the cylinder at one end (the left end as viewed from a person facing toward the front side in the running direction of the motorcycle) in the cylinder array direction in each of the first and second banks 23A and 23B, a second crank chamber 184 corresponding to the cylinder at the center in the cylinder array direction in the first bank 23A, and a third crank chamber 185 corresponding to the cylinder at the other end (the left end as viewed from a person facing toward the front side in the running direction of the motorcycle) in the cylinder array direction in each of the first and second banks 23A and 23B are formed in the crankcase 17.

Pistons 24 . . . in the cylinders at one-side ends in the cylinder array direction in the first and second banks 23A and 23B are connected to the crank pin 16*a* disposed in the first crank chamber 183 through connecting rods 29. . . . A piston 24 in the cylinder at the center in the cylinder array direction in the first bank 23A is connected to a crank pin 16*a* disposed in the second crank chamber 184 through a connecting rod 29. In addition, pistons 24 . . . in the cylinders as the other-side ends in the cylinder array direction in the first and second banks 23A and 23B are connected to a crank pin 16*a* disposed in the third crank chamber 185 through connecting rods 29. . . .

In addition, the upper and lower cases 17*a* and 17*b* are connected by a plurality of connecting bolts 186, 186 . . . disposed in the surroundings of the first to third crank chambers 183 to 185, and these connecting bolts 186, 186 . . . with lengths corresponding to their positions are passed through the lower case 17*b* from the lower side and are screw engaged with the upper case 17*a*.

An oil pan 25 is connected to a lower portion of the crankcase 17, i.e. a lower portion of the lower case 17*b*, and the crankcase 17 is provided with a partition wall 28 for partitioning between the first to third crank chambers 183 to 185 and a transmission chamber 27 defined by the crankcase 17 and the oil pan 25 so as to be located on the rear side and the lower side of these crank chambers 183 to 185.

A normally meshed-type gear transmission 30 is contained in the transmission chamber 27 on the rear side of the first to third crank chambers 183 to 185. The gear transmission 30 includes a plurality of stages, e.g., six stages of first-speed to sixth-speed gear trains G1 to G6 provided so as to be capable of selective establishment between a main shaft 31 and a counter shaft 32 both of which having an axis parallel to the crankshaft 16. The main shaft 31 is rotatably borne on the lower case 17*b* of the crankcase 17 at a portion corresponding to a position between the crankshaft 16 and the counter shaft 32. The counter shaft 32 is disposed to the rear side relative to the crankshaft 16 so as to be rotatably borne between connecting surfaces of the upper case 17*a* and the lower case 17*b*.

Motive power from the crankshaft 16 is inputted to the main shaft 31 through a clutch 34. The clutch 34 is a conventionally known multiple-disk type clutch including a clutch inner portion 37 non-rotatable relative to the main shaft 31, and a clutch outer portion 38 rotatable relative to the main shaft 31.

Meanwhile, the lower case 17*b* is provided with a left side support wall 187 disposed on the left side as viewed from a person faced to the front side in the running direction of the motorcycle, and a right side support wall 188 disposed on the right side as viewed from a person faced to the front side in the running direction, so as to determine both ends of the transmission chamber 27 in a direction along the axes of the main shaft 31 and the counter shaft 32. The upper case 17*a* is also provided with support walls corresponding respectively to the left side support wall. 187 and the right side support shaft 188 of the lower case 17*b*.

One end portion of the counter shaft 32 rotatably penetrates through the left side support walls 187 . . . of the crankcase 17, to protrude to the outside, and the other end portion of the counter shaft 32 is rotatably borne on the right side support walls 188 . . . of the crankcase 17. Moreover, a drive sprocket 35 is fixed to the end portion of the counter shaft 32 protruding from the left side support walls 187 . . . of the crankcase 17, and an endless form chain 36 for transmitting motive power to a rear wheel (not shown) is wrapped around the drive sprocket 35.

The upper and lower cases 17*a* and 17*b* are also connected by a plurality of connecting bolts 189 . . . and 190 . . . disposed in the surroundings of the transmission chamber 27, and the lengths of the connecting bolts 189 . . . and 190 . . . are appropriately set according to their positions. Moreover, the connecting bolts 189 . . . disposed on the crankshaft 16 side relative to the counter shaft 32 are passed through the lower case 17*b* from the lower side in the manner of avoiding a tightening work from the side of the second bank 23B disposed on the upper side, and are screw engaged with the upper case 17*a*. On the other hand, the connecting bolts 190 . . . disposed on the opposite side of the crankshaft 16 with respect to the counter shaft 32 can be easily tightened from the upper side, and, therefore, they are passed through the upper case 17A from the upper side and are screw engaged with the lower case 17*b*.

As shown in FIG. 1, the upper case 17*a* is provided with an arcuate ceiling wall portion 179 bulged upwards so as to cover the counter shaft 32 from the upper side, and the ceiling wall portion 179 is integrally connected to the cylinder block 18B of the second bank 23B at a substantially middle portion of the sliding range of the piston 24 in the cylinder block 18B.

With reference to FIG. 3, the first-speed main gear 191 constituting a part of the first-speed gear train G1 is provided integrally on the main shaft, and second-speed to sixth-speed main gears 192 to 196 constituting part of the second-speed to sixth-speed gear trains G2 to G6 are relatively non-rotatably mounted to the main shaft 31. The first-speed to sixth-speed main gears 191 to 196 are arrayed in the order, from one end side of the main shaft 31, of the second-speed main gear 192, the sixth-speed main gear 196, the third-speed main gear 193, the fourth-speed main gear 194; the fifth-speed main gear 195 and the first-speed main gear 191.

Figure 4A:
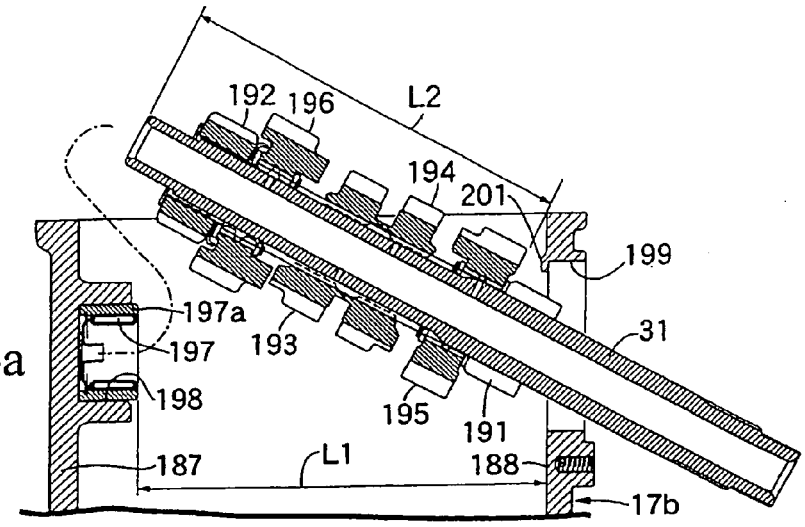
FIGS. 4*a–c* are sectional views along line 4—4 of FIG. 3 illustrating the procedure of mounting a main shaft onto a lower case.
Figure 4B:
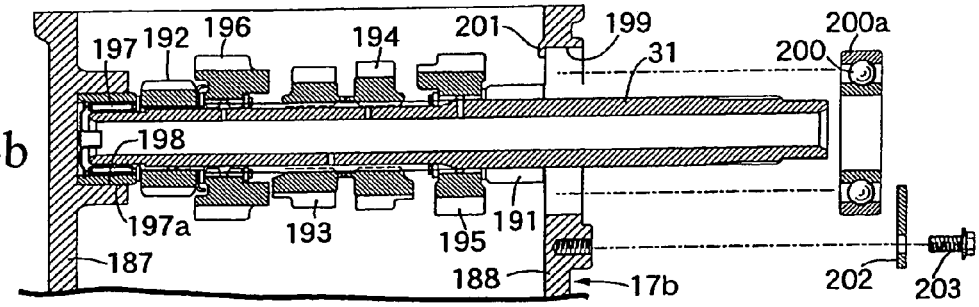
Figure 4C:
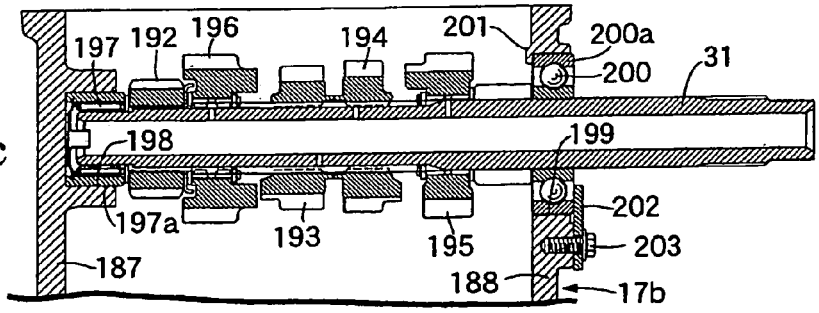

Referring to FIGS. 2–4, one end of the main shaft 31 is rotatably borne on the left side support wall 187 of the lower case 17*b* through a needle bearing 197, and the inside surface of the left side support wall 187 is provided with a bottomed first bearing hole 198 in which to fit an outer ring 197*a* of the needle bearing 197. On the other hand, the main shaft 31 rotatably penetrates through the right side support wall 188 of the lower case 17*b*, and a ball bearing 200 is interposed between the outer periphery of the main shaft 31 and the inner periphery of a second bearing 199 provided in the right side support wall 188 so that an intermediate portion of the main shaft 31 penetrates therethrough.

Moreover, the outside diameter of an outer ring 200*a* of the ball bearing 20, i.e. the inside diameter of the second bearing hole 199, is set to be smaller than the diameter of the sixth-speed main gear 196 having the maximum diameter among the first-speed to sixth-speed main gears 191 to 196. In this embodiment, the diameter in question is smaller than the diameter of the fifth-speed main gear 195.

At the time of mounting the main shaft 31 to the lower case 17*b*, first, as shown in FIG. 4(*a*), the outer ring 197*a* of the needle bearing 197 is fitted and held in the first bearing hole 198 in the left side support wall 187, and the main shaft 31 on which to provide the first-speed to sixth-speed main gears 191 to 196 is inserted into the second bearing hole 199 from the other end side. In this case, the first-speed main gear 191 integrally formed on the main shaft 31 must be inserted into the second bearing hole 199, and, therefore, the inside diameter of the second bearing hole 199 is so set as to accommodate the first-speed main gear 191. In addition, in order to enable one end of the main shaft 31 to be fitted in the needle bearing 197 fitted and held in the first bearing hole 198 in the condition where the first-speed main gear 191 is inserted in the second bearing hole 199, the length L2 between one end of the main shaft 31 and the end portion on the first-speed gear 191 side of the fifth-speed main gear 195 is set to be smaller than the length L1 between the inner ends of the needle bearing 198 and the second bearing hole 199.

Next, as shown in FIG. 4(*b*), in the condition where an intermediate portion of the main shaft 31 having one end fitted in the needle bearing 197 penetrates through the second bearing hole 199, the ball bearing 200 is fitted over the main shaft 31 from the other end side, and the outer ring 200*a* of the ball bearing 200 is fitted into the second bearing hole 199 from the outside, as shown in FIG. 4(*c*).

The right side support wall 188 is integrally provided on its inside surface with a projected portion 201 projected inwards from the inner end of the second bearing hole 199 so as to receive one end of the outer ring 200*a*. In addition, a support plate 202 intended to abut on the outer end of the outer ring 200*a* is fastened to the outside surface of the right side support wall 188 by a screw member 203, and the ball bearing 200 is interposed between the outer periphery of the main shaft 31 and the inner periphery of the second bearing hole 199 so that its movement in the axial direction is restricted by the projected portion 201 and the support plate 202.

With reference to FIGS. 2 and 3, one end portion of the crankshaft 16 is projected from the upper and lower journal walls 180 and 181 located on the left end, as viewed from a person faced to the front side in the running direction of the motorcycle, of the upper and lower journal walls 180 . . . and 181 . . . of the crankcase 17, and an outer rotor 45 of a generator 44 is fixed to the other end portion of the crankshaft 16. In addition, an inner stator 46 constituting the generator 44 together with the outer rotor 45 is fixed to a generator cover 47 connected to a left side support wall of the crankcase 17 so as to cover the generator 44. In addition, a gear 49 is connected to the outer rotor 45 through a one-way clutch 48, and the gear 49 is connected, for operation in conjunction, to a starter motor (not shown).

In addition, the other end portion of the crankshaft 16 is projected from the upper and lower journal walls. 180 and 181 located at the right end, as viewed from a person faced to the front side in the running direction of the motorcycle, of the upper and lower journal walls 180 . . . and 181 . . . of the crankcase 17. A primary drive gear 41 having a comparatively large diameter is fixed to the other end portion of the crankshaft 16 on the outer side of the crankcase 17, and a primary driven gear 42 meshed with the primary drive gear 41 is connected to the clutch outer portion 38 of the clutch 34 through a damper spring 43.

Figure 5:
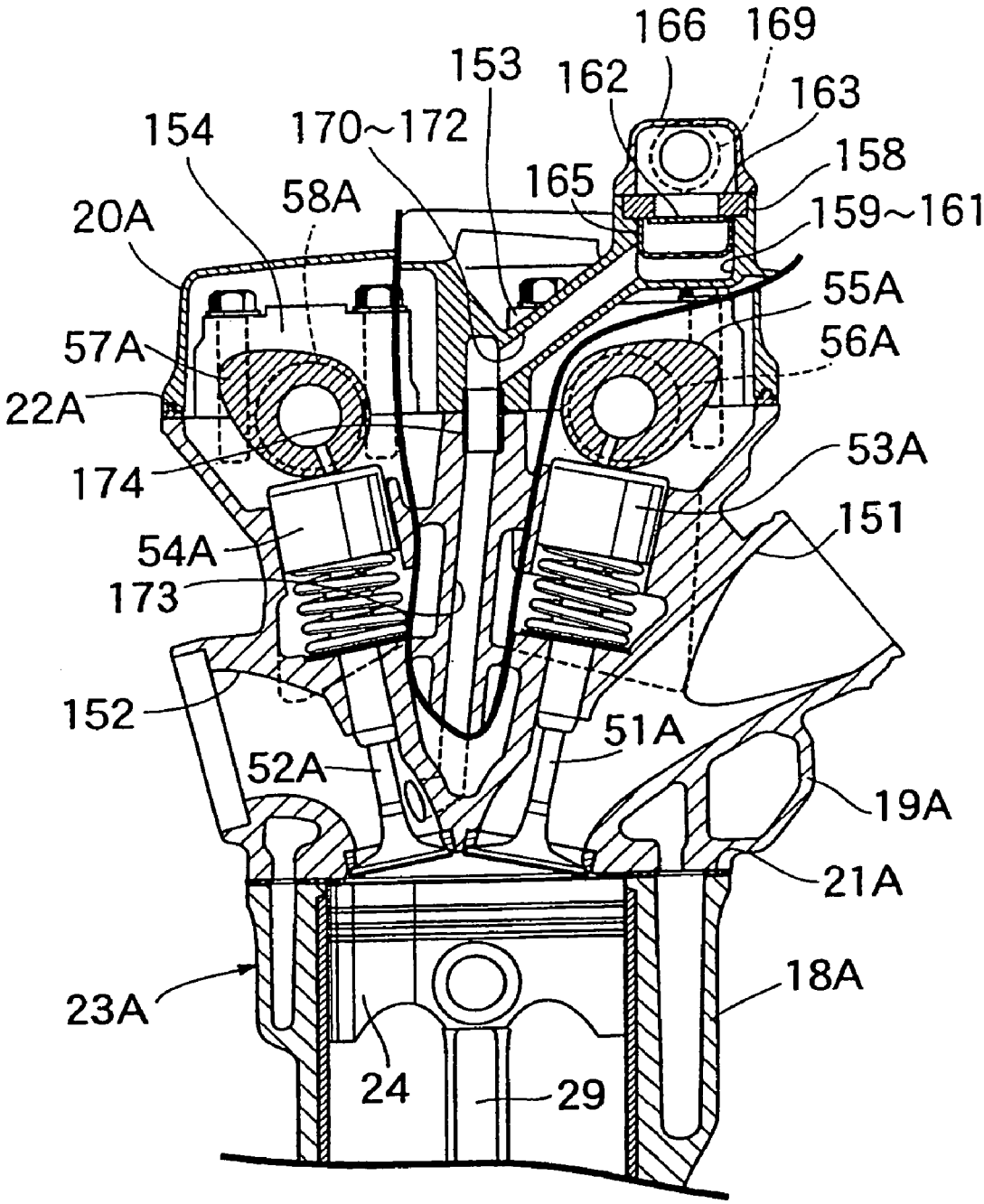
FIG. 5 is a sectional view along line 5—5 of FIG. 2.

Referring now to FIG. 5, in the first cylinder head 19A of the first bank 23A, intake ports 151 . . . opening to the inner side of both the banks 23A and 23B and exhaust ports 152 . . . opening in a side wall on the opposite side of the intake ports 151 . . . are provided on the basis of each cylinder. A pair of intake valves 51A . . . for each of the intake ports 151 . . . and a pair of exhaust valves 52A . . . for each of the exhaust ports 152 . . . are disposed in the first cylinder head 19A so as to be openable and closable while being spring-biased in a valve-closing direction. Moreover, bottomed cylindrical intake valve side lifters 53A . . . whose closed end inside surfaces are brought into abutment on top portions of the intake valves 51A . . . and bottomed cylindrical exhaust valve side lifters 54A . . . whose closed end inside surfaces are brought into abutment on top portions of the exhaust valves 52A . . . are fitted in the first cylinder head 19A so as to be slidable in the opening-closing directions of the intake valves 51A . . . and the exhaust valves 52A. . . .

Moreover, an intake-side camshaft 56A having a plurality of intake-side cams 55A to be brought into sliding contact with the closed end surfaces of the intake valve side lifters 53A . . . is borne to be rotatable about an axis parallel to the crankshaft 16 by the first cylinder head 19A and an intake-side cam holder 153 fastened to the first cylinder head 19A, and an exhaust-side camshaft 58A having a plurality of exhaust-side cams 57A . . . to be brought into sliding contact with the closed end outside surfaces of the exhaust-side lifters 54A . . . is borne to be rotatable about an axis parallel to the crankshaft 16 by the first cylinder 19A and an exhaust-side cam holder 154 fastened to the first cylinder head 19A.

Figure 6:
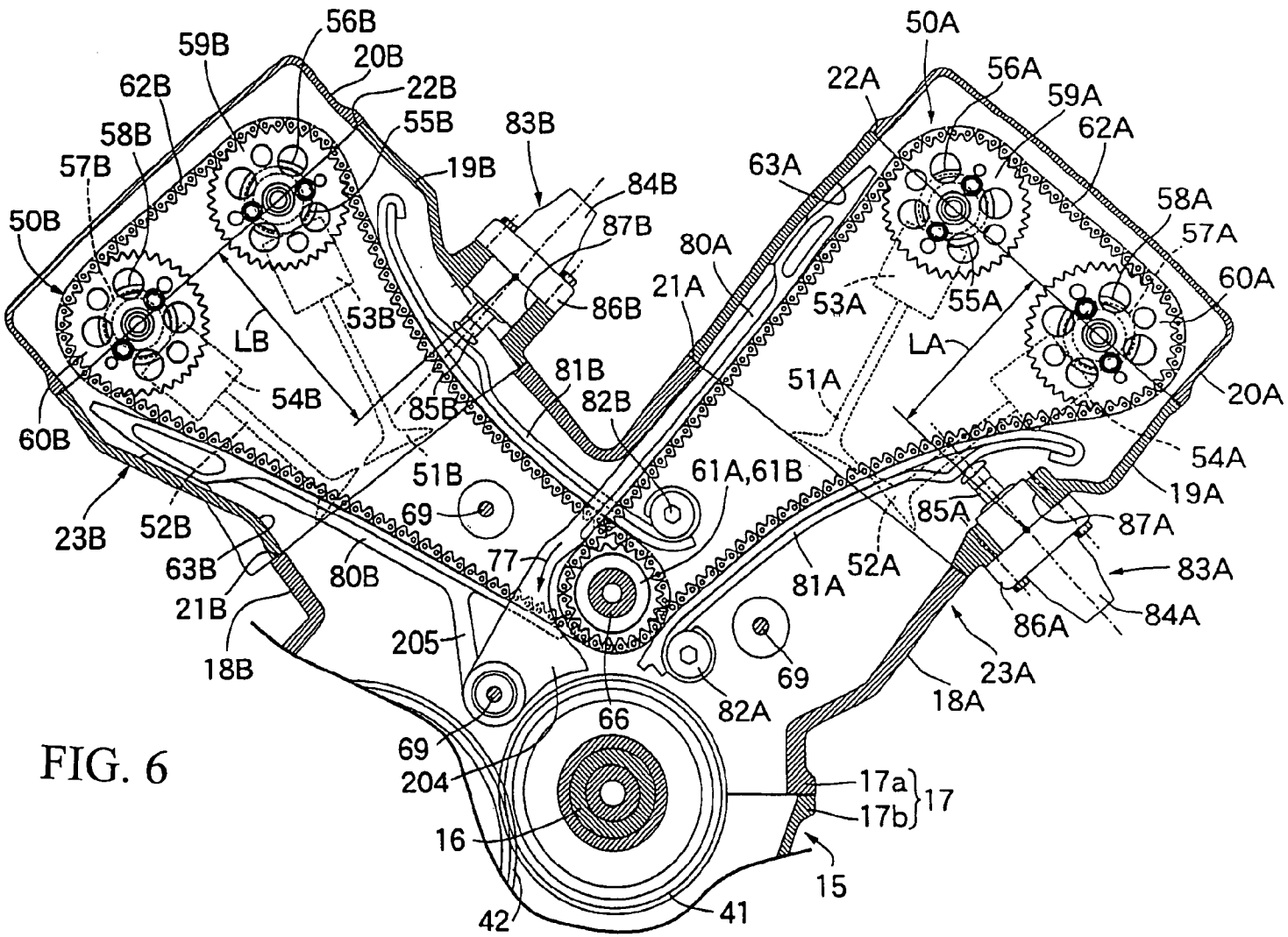
FIG. 6 is a sectional view along line 6—6 of FIG. 2.

Referring to FIGS. 5 and 6, in the second cylinder head 19B of the second bank 23B, a pair of intake valves 51B . . . and a pair of exhaust valves 52B . . . on the basis of each cylinder are disposed to be openable and closable while being spring-biased in a valve closing direction. Intake-side cams 55B . . . on the intake-side camshaft 56B rotatable about an axis parallel to the crankshaft 16 are put in sliding contact with intake valve side lifters 53B . . . abutting on top portions of the intake valves 51B . . . , and exhaust-side cams 57B . . . on the exhaust-side camshaft 58B rotatable about an axis parallel to the crankshaft 16 are put in sliding contact with exhaust valve side lifters 54B . . . abutting on top portions of the exhaust valves 52B . . . .

Figure 7:
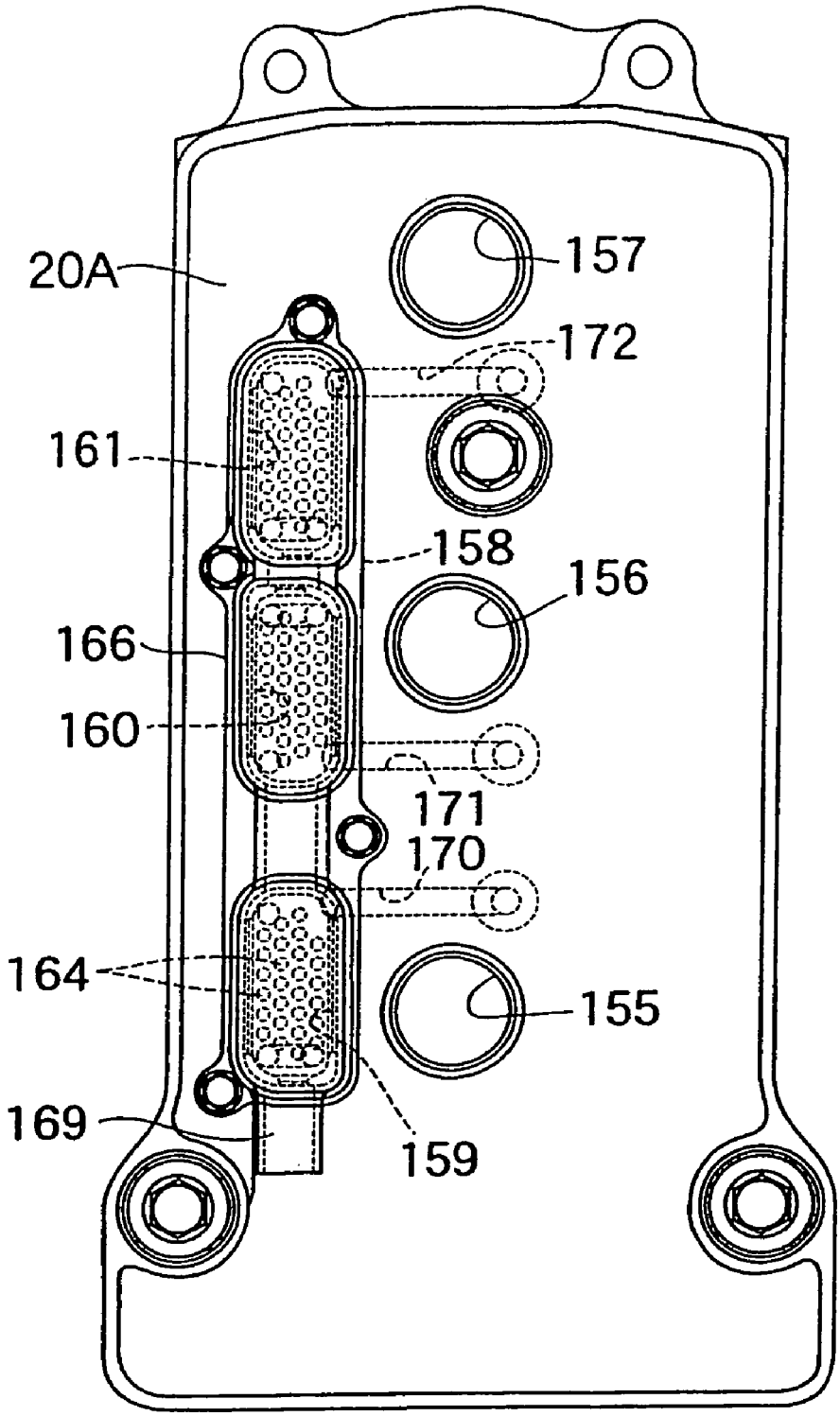
FIG. 7 is a view along arrow 7 of FIG. 1.

With reference to FIG. 7, the first head cover 20A of the first bank 23A is provided with three plug passing holes 155, 156 and 157 for passing spark plugs (not shown) at positions corresponding to central portions of the cylinders, at equal intervals sequentially from the right side toward the left side as viewed from a person faced to the front side in the running direction of the motorcycle. In addition, on the rear side relative to the plug passing holes 155 to 157, a mount tube portion 158 having a cross-sectional shape that is elongate in the array direction of the plug passing holes 155 to 157 are projectingly provided on and integral with the upper surface of the first head cover 20A, and the mount tube portion 158 is provided therein with three mount recessed portions 159, 160 and 161 at equal intervals sequentially from the right side toward the left side as viewed from a person faced to the front side in the running direction of the motorcycle in such a manner that partition walls 158*a*, 158*b* having upper surfaces flush with the upper surface of a side wall of the mount tube portion 156 are formed between them.

Of the mount recessed portions 159 to 161, the mount recessed portions 159 and 160 are disposed at positions corresponding substantially to the plug passing holes 155 and 156, respectively, whereas the mount recessed portion 161 is disposed at a position corresponding substantially to an intermediate portion between the plug passing holes 156 and 157. Specifically, the distance between the mount recessed portion 160 disposed at an intermediate position of the mount recessed portions 159 to 161 and the mount recessed portion 159 disposed on the right side of the mount recessed portion 160 is set greater than the distance between the mount recessed portion 160 disposed at the intermediate position and the mount recessed portion 161 disposed on the left side of the mount recessed portion 160, and the mount recessed portions 160 and 161 are disposed close to each other.

As shown in FIG. 2, ring-shaped support members 163 with reed valves 162 attached thereto are pressed into the mount recessed portions 159 to 161, and protecting members 165 formed in a bottomed cylindrical shape with a plurality of small holes 164 . . . (see FIG. 7) are pressed in at positions on the inner side relative to the reed valves 162.

A cap 166 is fastened to the mount tube portion 158 so as to cover the mount tube portion 158 from the upper side. The cap 166 is provided with partition walls 166*a* and 166*b* abutting on the partition walls 158*a* and 158*b* of the mount tube portion 158 from the upper side, and the partition walls 166*a* and 166*b* are provided with coaxial communication holes 167 and 168. A connection tube portion 169 extending coaxially with the communication holes 167 and 168 is projectingly provided on and integrally with the cap 166, and a conduit (not shown) for guiding secondary air is connected to the connection tube portion 169. Namely, secondary air is guided to the area between the cap 166 and the mount tube portion 158.

In addition, the first head cover 20A is provided with secondary air passages 170, 171 and 172 opening in the closed end inside surfaces of the mount recessed portions 159 to 161, the secondary air passages 170 and 171 are disposed between the plug passing holes 155 and 156, and the secondary air passage 172 is disposed between the plug passing holes 156 and 157.

On the other hand, as shown in FIG. 5, the first cylinder head 19A is provided with secondary air passages 173 . . . having lower end portions opened into the exhaust ports 152 . . . of the cylinders and extending upwards, and the upper ends of the secondary air passages 173 . . . are communicated with the secondary air passages 173 . . . in the first head cover 20A through connecting pipes 174 . . . clamped between the first head cover 20A and the first cylinder head 19A so as to function also as positioning pins.

According to the secondary air supply structure on the first bank 23A side as above, the connection tube portion 158 provided in the first head cover 20A and the cap 166 mounted to the connection tube portion 158 can be made compact.

Besides, in the second bank 23B, in order to supply secondary air into two cylinders on the second bank 23B side, as shown in FIG. 1, a connection tube portion 175 is projectingly provided on the second head cover 20B, and a cap 176 is attached to the connection tube portion 175. The shapes of the connection tube portion 175 and the cap 176 are different from those of the connection tube portion 168 and the cap 166 on the first bank 23A side, but the reed valve layout structure and the passage structure for guiding secondary air from the reed valve to the exhaust port are the same as those on the first bank 23A side.

Again in FIG. 6, the rotational motive power of the crankshaft 16 is transmitted to the intake-side and exhaust-side camshafts 56A and 58A in the first bank 23A through the power transmission means 50A, and the rotational motive power of the crankshaft 16 is transmitted to the intake-side and exhaust-side camshafts 56B and 58B in the second bank 23B through the power transmission means 50B.

The power transmission means 50A on the first bank 23A side includes intake-side and exhaust-side driven sprockets 59A and 60A fixed to one-side end portions of the intake-side and exhaust-side camshafts 56A and 58A, a first bank drive sprocket 61A operated in conjunction with the rotation of the crankshaft 16, an endless form cam chain 62A forming an endless form power transmission member wrapped around the first bank drive sprocket 61A and the intake-side and exhaust-side driven sprockets 59A and 60A, a chain guide member 80A making contact with the outer periphery on the tension side of the cam chain 62A, a chain tensioner 81A making contact with the outer periphery on the loosening side of the cam chain 62A, and a tensioner lifter 83A abutting on the chain tensioner 81A from the opposite side of the cam chain 62A.

The power transmission means 50B on the second bank 23B side includes intake-side and exhaust-side driven sprockets 56B and 58B fixed to one-side end portions of the intake-side and exhaust-side camshafts 56B and 58B, a second bank drive sprocket 61B operated in conjunction with the rotation of the crankshaft 16, an endless form cam chain 62B forming an endless form power transmission member wrapped around the second bank drive sprocket 61B and the intake-side and exhaust-side driven sprockets 59B and 60B, a chain guide member 80B making contact with the outer periphery on the tension side of the cam chain 62B, a chain tensioner making contact with the outer periphery on the loosening side of the cam chain 62B, and a tensioner lifter 83B abutting on the chain tensioner 81B from the opposite side of the cam chain 62B.

On the other hand, the first bank drive sprocket 61A and the second bank drive sprocket 61B rotated about axes parallel to the crankshaft 16 are disposed on the outer side of the right side wall in the crankcase 17 and on the upper side of one end portion of the crankshaft 16. The first cylinder block 18A, the first cylinder head 19A and the first head cover 20A of the first bank 23A on the other end side of the crankshaft 16 is provided with a chain passage 63A for running the cam chain 62A therein, while the second cylinder block 18B, the second cylinder head 19B and the second head cover 20B of the second bank 23B on the other end side of the crankshaft 16 are provided with a chain passage 63B for running the cam chain 62B therein.

Figure 8:
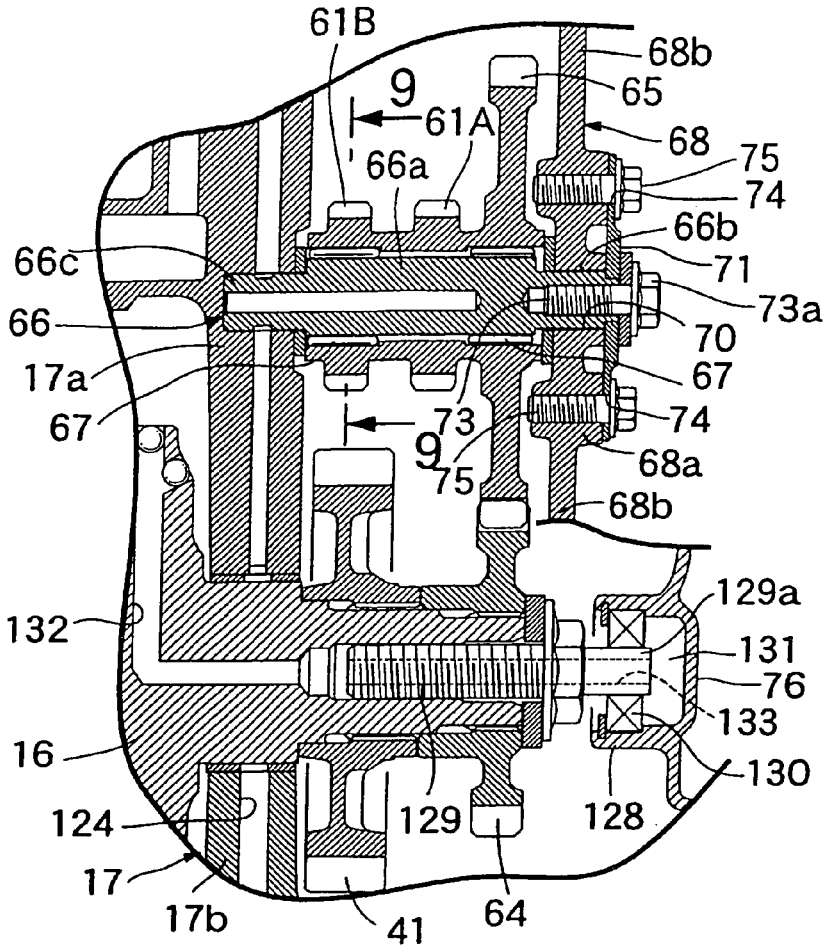
FIG. 8 is an enlarged view of a major part of FIG. 2.

Referring to FIG. 8, at the other end portion of the crankshaft 16, an idler drive gear 64 formed to be smaller in diameter than the primary drive gear 41 is provided on the outer side in the axial direction relative to the primary drive gear 41 so that its outer periphery is opposed to the clutch 34 interposed between the crankshaft 16 and the gear transmission 30. In addition, an idle gear 65 as a conjunction rotational member meshed with the idler drive gear 64 is rotatably borne on an idle shaft 66 having an axis parallel to the crankshaft 16. Moreover, the first bank drive sprocket 61A and the second bank drive sprocket 61B are provided on the inner side in the axial direction of the idle gear 65 coaxially with and adjacently to the idle gear 65 so that at least parts of the outer peripheries thereof are opposed to the primary drive gear 41.

The first bank drive sprocket 61A and the second bank drive sprocket 61B are formed integrally with the single idle gear 65 which is common for both of the drive sprockets 61A and 61B. The assembly composed of the intake-side and exhaust-side driven sprockets 59A and 60A fixed to the intake-side and exhaust-side camshafts 56A and 58A on the first bank 23A side so as to drive the camshafts 56A and 58A, the first bank drive sprocket 61A and the cam chain 62A and the assembly composed of the intake-side and exhaust-side driven sprockets 59B and 60B fixed to the intake-side and exhaust-side camshafts 56B and 58B on the second bank 23B side so as to drive the camshafts 56B and 58B, the second bank drive sprocket 61B and the cam chain 62B are disposed adjacently to each other on the other end side in the axial direction of the crankshaft 16.

Figure 9:
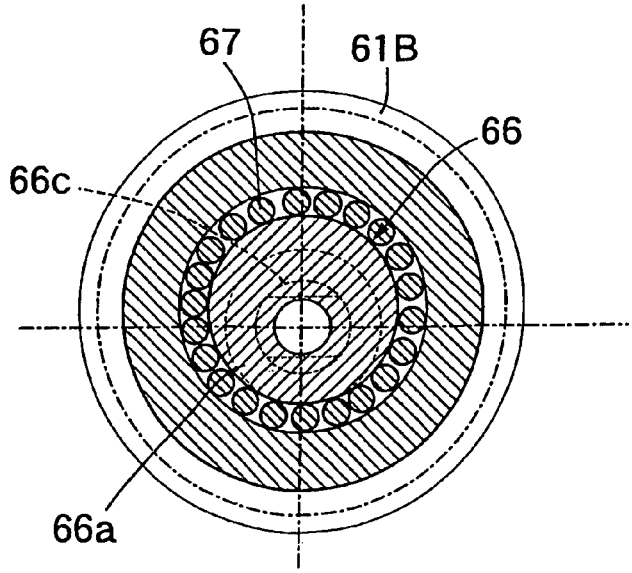
FIG. 9 is an enlarged sectional view along line 9—9 of FIG. 8.

Referring to FIG. 9, the idle shaft 66 has integrally an eccentric shaft portion 66*a* as an intermediate portion thereof, and support shaft portions 66*b* and 66*c* being continuous with both ends of the eccentric shaft portion 66*a* and having the same axis set off from the axis of the eccentric shaft portion 66*a*. The idle gear 65, the first bank drive sprocket 61A and the second bank drive sprocket 61B are rotatably borne on the eccentric shaft portion 66*a* through a pair of needle bearings 67, 67.

Moreover, the idle shaft 66 is supported on the crankcase 17 so as to be capable of turning about the axis of the support shaft portions 66*b* and 66*c*, i.e. capable of turning about an axis set off from the axis of the eccentric shaft portion 66*a*. The support shaft portion 66*b* on one end side of the idle shaft 66 is turnably supported on a shaft holder 68 serving as a support member fastened to a right side support wall of the crankcase 17 as viewed from a person faced to the front side in the running direction of the motorcycle, and the support shaft portion 66*c* on the other end side of the idle shaft 66 is turnably supported on the right side support wall of the crankcase 17.

Figure 10:
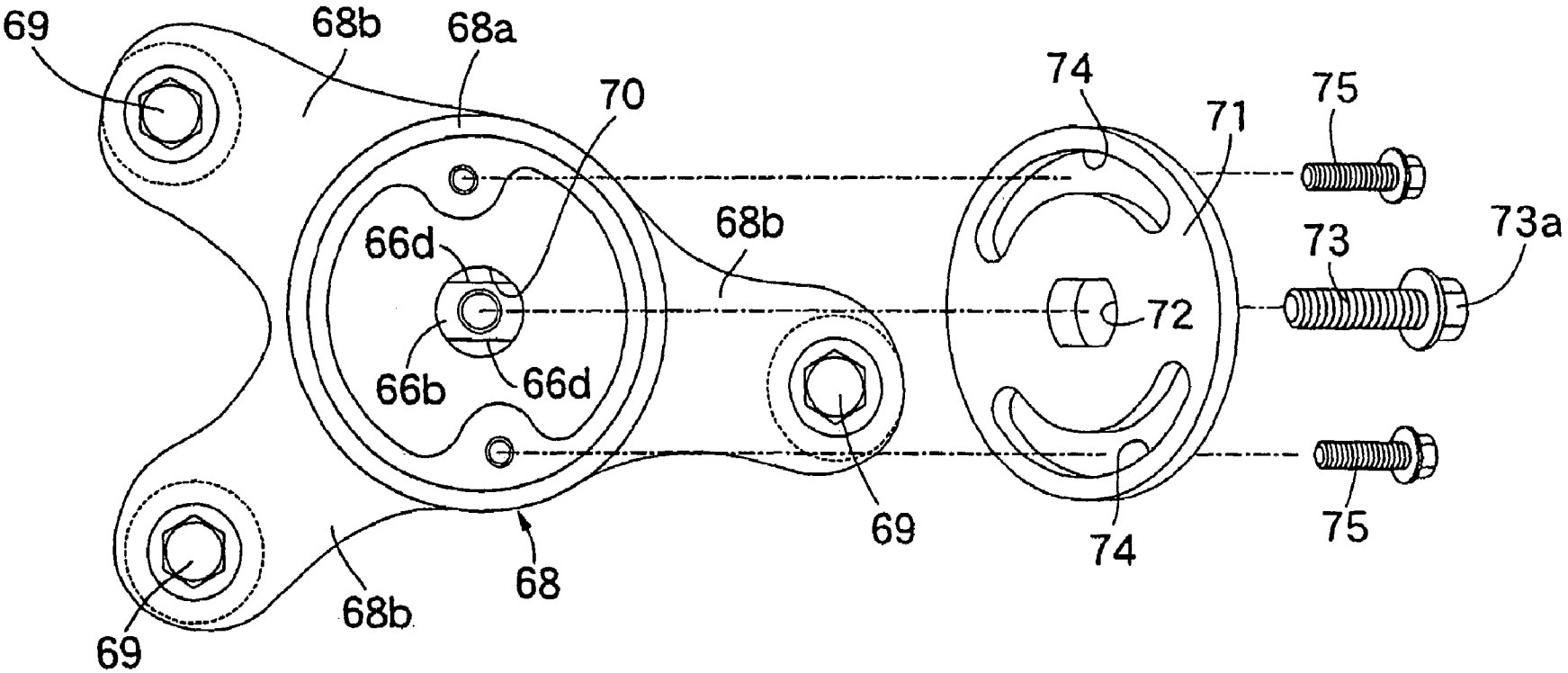
FIG. 10 is an exploded perspective view of a shaft holder and a restricting plate.

Referring to FIG. 10, the shaft holder 68 has integrally a disk-like support portion 68*a*, and support arm portions 68*b* . . . projected outwards from a plurality of locations, for example three locations, in the circumferential direction of the support portion 68*a*, and tip end portions of the support arm portions 68*b* . . . are fixed to the right side support wall of the crankcase 17 by bolts 69 . . . at such locations as not to hinder the running of the cam chains 62A and 62B. The support portion 68*a* is provided in its central portion with a circular support hole 70, and the support portion 66*b* on one end side of the idle shaft 66 is turnably fitted and supported in the support hole 70. Moreover, a tip end portion of the support portion 66*b* on one end side of the idle shaft 66 is formed to have a non-circular cross-sectional shape so as to have, for example, a pair of mutually parallel flat surfaces 66*d* . . . at its outer periphery.

A circular restricting plate 71 is disposed on the outer side of the support portion 68*a* of the shaft holder 68. The restricting plate 71 is provided in its central portion with a restricting hole 72 in which a tip end portion of the support shaft portion 66*b* is to be relatively non-rotatably fitted, the hole 72 having a shape corresponding to the cross-sectional shape of the tip end portion of the support shaft portion 66*b*. A bolt 73 is screw engaged with the support shaft portion 66*b*, with its enlarged diameter head portion 73*a* engaged with the restricting plate 71. This fixes the restricting plate 71 to the support shaft portion 66*b*.

In addition, at for example two locations in the surroundings of the restricting hole 72, the restricting plate 71 is provided with arcuate slots 74, 74 centered on the axis of the support shaft portion 66*b*, and bolts 75, 75 passed through the slots 74, 74 are screw engaged with the support portion 68*a* of the shaft holder 68.

In the condition where the bolts 75 . . . are fastened, the idle shaft 66 is inhibited from turning about the axis of the support shaft portions 66*b* and 66*c*. However, when the bolts 75 . . . are unfastened, turning of the idle shaft 66 about the axis of the support shaft portions 66*b* and 66*c*, i.e., turning of the idle shaft 66 about an axis set off from the axis of the eccentric shaft portion 66*a* is permitted.

Besides, a cover 76 for covering the clutch 34 and for covering one end portion of the crankshaft 16 and the shaft holder 68 is connected to the right side wall of the crankcase 17 to as to be continuous with the cylinder blocks 18A and 18B of the first and second banks 23A and 23B.

With reference to FIG. 6, the first bank drive sprocket 61A and the second bank drive sprocket 61B are turned in the direction indicated by arrow 77. On the first bank 23A side, the portion between the first bank drive sprocket 61A and the exhaust-side driven sprocket 60A, i.e., the portion corresponding to the outside of both banks 23A and 23B, of the cam chain 62A is the loosening side, while the portion between the intake-side driven sprocket 59A and the first bank drive sprocket 61A, i.e., the portion corresponding to the inside of both banks 23A and 23B, of the cam chain 62 is the tension side. On the second bank 23B side, the portion between the second bank drive sprocket 61B and the exhaust-side driven sprocket 60B, i.e., the portion corresponding to the outside of both banks 23A and 23B, of the cam chain 62B is the loosening side, while the portion between the intake-side driven sprocket 59B and the second bank drive sprocket 61B, i.e., the portion corresponding to the inside of both banks 23A and 23B, of the cam chain 62B is the tension side.

A chain guide member 80A making contact with the tension-side outer periphery of the cam chain 62A on the first bank 23A side, a chain tensioner 81A making contact with the loosening-side outer periphery of the cam chain 62A on the first bank 23A side, a chain guide member 80B making contact with the tension-side outer periphery of the cam chain 62B on the second bank 23B side, and a chain tensioner 81B making contact with the loosening-side outer periphery of the cam chain 62B on the second bank 23B side, are mounted to the crankcase 17.

An end portion 204 on the first bank drive sprocket 61A side of the chain guide member 80A on the first bank 23A side is so formed as to cover from outside at least a part of the portion, around which the cam chain 62A is wrapped, of the outer periphery of the first bank drive sprocket 61A, and, in this embodiment, is so formed as to extend around to the lower side of the first bank drive sprocket 61A.

Figure 11:
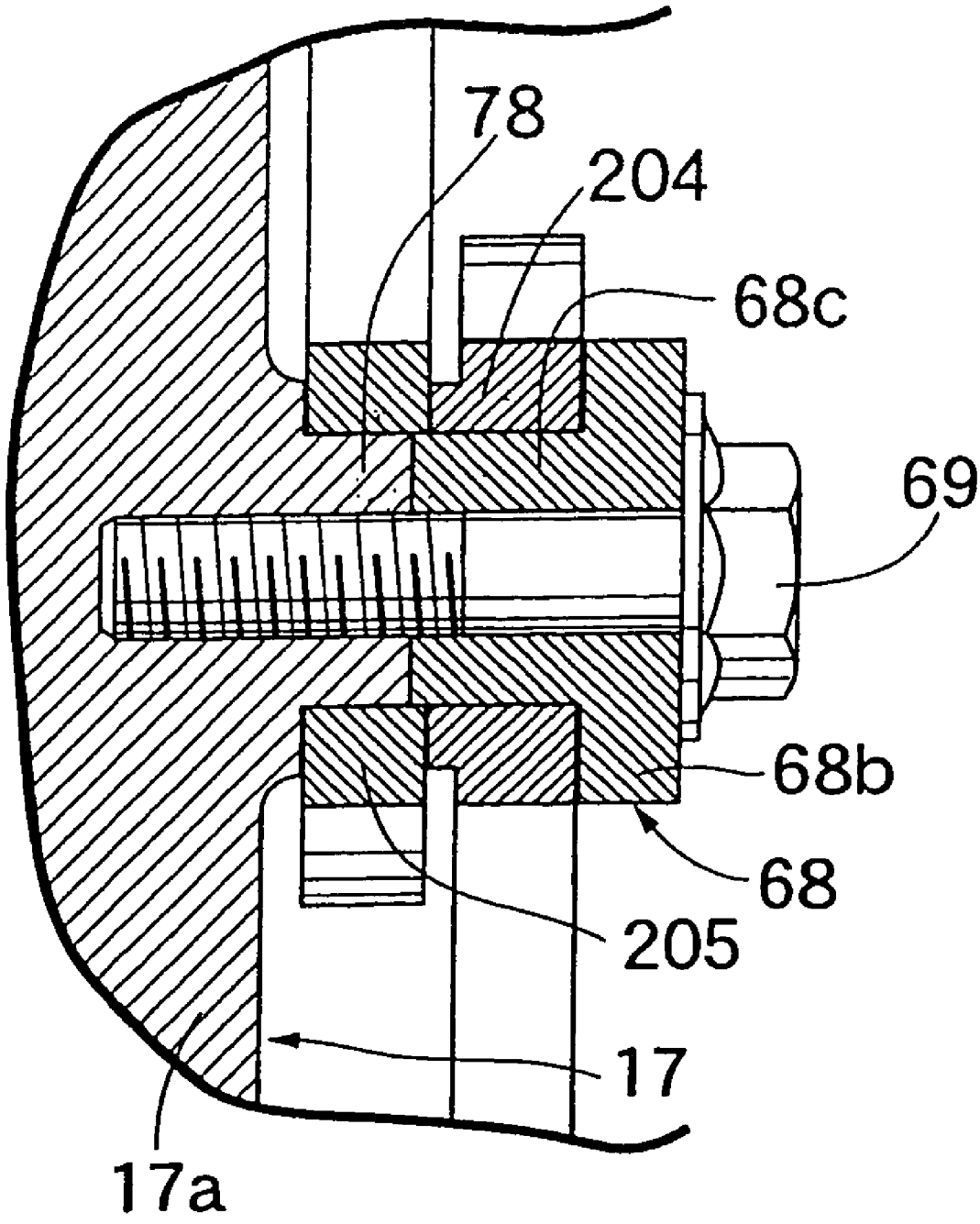
FIG. 11 is an enlarged sectional view along line 11—11 of FIG. 1.

Referring to FIG. 11, the chain guide member 80B on the second bank 23B side is provided with a support portion 205 of which a tip end portion is clamped between the end portion 204 of the chain guide member 80A on the first bank 23A side and the crankcase 17. The end portion 204 of the chain guide member 80A and the support portion 205 of the chain guide member 80B are laid on each other in the vicinity of and on a slantly lower side of the side of the first and second bank drive sprockets 61A and 61B.

Moreover, cylindrical portions 68*c* . . . abutting on cylindrical support bosses 78 . . . integrally projectingly provided on the upper case 17*a* of the crankcase 17 are integrally projectingly provided on the three support arm portions 68*b* . . . possessed by the shaft holder 68 for supporting the idle shaft 66. The shaft holder 68 is fixed to the upper case 17*a* of the crankcase 17 by tightening the bolts 69 . . . passed through the cylindrical portions 68*c* . . . and screw engaged with the support bosses 78. . . . One of the support arm portions 68*b* . . . is disposed at such a position as to clamp, between itself and the crankcase 17, the end portion 204 and the support portion 205 which are laid on each other. The end portion 204 of the chain guide member 80A and the support portion 205 of the chain guide member 80B are supported by the cylindrical portion 68*c* and the support boss 78.

Moreover, upper portions of both chain guide members 80A and 80B abut on and are supported by the inside walls of the first and second cylinder heads 19A and 19B in both banks 23A and 23B.

The chain tensioner 81A on the first bank 23A side is formed in a bow shape so that its convex surface makes sliding contact with the loosening-side outer periphery of the cam chain 62A at a portion corresponding to the outside of both banks 23A and 23B, whereas the chain tensioner 81B on the second bank 23B side is formed in a bow shape so that its convex surface makes sliding contact with the loosening-side outer periphery of the cam chain 62B at a portion corresponding to the inside of both banks 23A and 23B. One-side end portions on the crankshaft 16 side of the chain tensioners 81A and 81B are turnably borne on the crankcase 17 through pivotal shafts 82A and 82B.

Tensioner lifters 83A and 83B abut on the chain tensioners 81A and 81B of the first and second banks 23A and 23B from the opposite side of the cam chains 62A and 62B so as to give a tension to the loosening side of the cam chains 62A and 62B, and the tensioner lifters 83A and 83B are provided respectively in the cylinder heads 19A and 19B of both banks 23A and 23B.

Specifically, the tensioner lifter 83A of the first bank 23A is provided in the first cylinder head 19A at a portion corresponding to the outside of both banks 23A and 23B, while the tensioner lifter 83B of the second bank 23B is provided in the second cylinder head 19B at a portion corresponding to the inside of both banks 23A and 23B.

The tensioner lifters 83A, 83B are conventionally known ones which include cylindrical cases 84A, 84B, and push rods 85A, 85B projecting from one-side ends of the cases 84A, 84B and biased in the projecting directions. The cases 84A, 84B are fitted in mount holes 87A, 87B formed in the first and second cylinder heads 19A, 19B so that the tip ends of the push rods 85A, 85B make contact with the outer peripheries of the cam chains 62A, 62B, and flanges 86A, 86B projecting radially outwards from intermediate portions of the cases 84A, 84B are fastened to the first and second cylinder heads 19A, 19B.

Moreover, the distance LA from the top connection surface 22A of the first cylinder head 19 to the tensioner lifter 83A on the first bank 23A side is set to be smaller than the distance LB from the top connection surface 22B of the second cylinder head 19B to the tensioner lifter 83B on the second bank 23B side.

In addition, a portion, projecting from the second cylinder head 19B of the second bank 23B, of the tensioner lifter 83B is disposed slantly so as to approach the top connection surface 22B of the second cylinder head 19B as one goes outwards. In addition, a portion, projecting from the first cylinder head 19A of the first bank 23A, of the tensioner lifter 83A is disposed slantly so as to space away from the top connection surface 22A of the first cylinder head 19A as one goes outwards.

Referring to FIGS. 12–15, an oil pump 93 composed of a feed pump 91 and a scavenging pump 92 having a common oil pump shaft 90 is disposed at a lower portion of the transmission chamber 27, and a pump housing 94 of the oil pump 93 is mounted from the lower side to the partition wall 28 provided in the crankcase 17.

The pump housing 94 includes a housing main body 95, and first and second covers 96 and 97 clamping the housing main body 95 from both sides, which are fastened to each other by a plurality of bolts 98 . . . . A mount portion 95*a* formed as one body with the housing main body 95 and extending upwards is fastened to the partition wall 28, and the oil pump shaft 90 rotatably penetrates through the pump housing 94. Moreover, a pump driven sprocket 99 is fixed to one end portion of the oil pump shaft 90, and, as shown in FIG. 2, an endless form chain 101 is wrapped around a pump drive sprocket 100, which is borne on the main shaft 31 on the outer side of the crankcase 17 so as to rotate together with the primary driven gear 42, and the pump driven sprocket 99. Therefore, the feed pump 91 and the scavenging pump 92 are driven by motive power transmitted from the main shaft 31 operated in conjunction with the crankshaft 16.

The feed pump 91 and the scavenging pump 92 are of the trochoid type. The feed pump 91 includes an inner rotor 102 fixed to the oil pump shaft 90, and an outer rotor 103 meshed with the inner rotor 102, which are contained between the housing main body 95 and the first cover 96. The scavenging pump 92 includes an inner rotor. 104 fixed to the oil pump shaft 90, and an outer rotor 105 meshed with the inner rotor 104, which are contained between the housing main body 95 and the second cover 97.

The first cover 96 of the pump housing 94 is provided with a suction passage 106 for sucking oil into the feed pump 91, at least an upstream portion of the suction passage 106 is formed to extend vertically, and the upstream end of the suction passage 106 opens at the lower end of the first cover 96 so as to open downwards.

The feed pump 91 sucks in the oil present in the oil pan 25 through an oil strainer 107 disposed in the oil pan 25, and the oil strainer 107 is connected to the suction passage 106.

A casing 108 of the oil strainer 107 is composed of an upper-lower pair of members coupled to each other, and includes a flat casing main portion 108*a*, a connection pipe portion 108*b* extending upwards from the casing main portion 108*a*, and a suction pipe portion 108*c* extending downwards from the casing main portion 108*a* so as to become gradually smaller as one goes downwards and being formed at its lower end with a suction port 110. A lower portion of the casing 108 is formed in a funnel-like shape.

An upper end portion of the connection pipe portion 108*b* is fitted in the upper end of the suction passage 106 through an annular seal member 109, and an upper end portion of the casing 108 is supported by the first cover 96 of the pump housing 94 mounted to the partition wall 28 of the crankcase 17. Namely, a lower portion of the casing 108 having an upper end portion supported on the crankcase 17 side through the pump housing 94 is formed in the funnel-like shape, and the suction port 110 is formed at the lower end of the casing 108.

Figure 13:
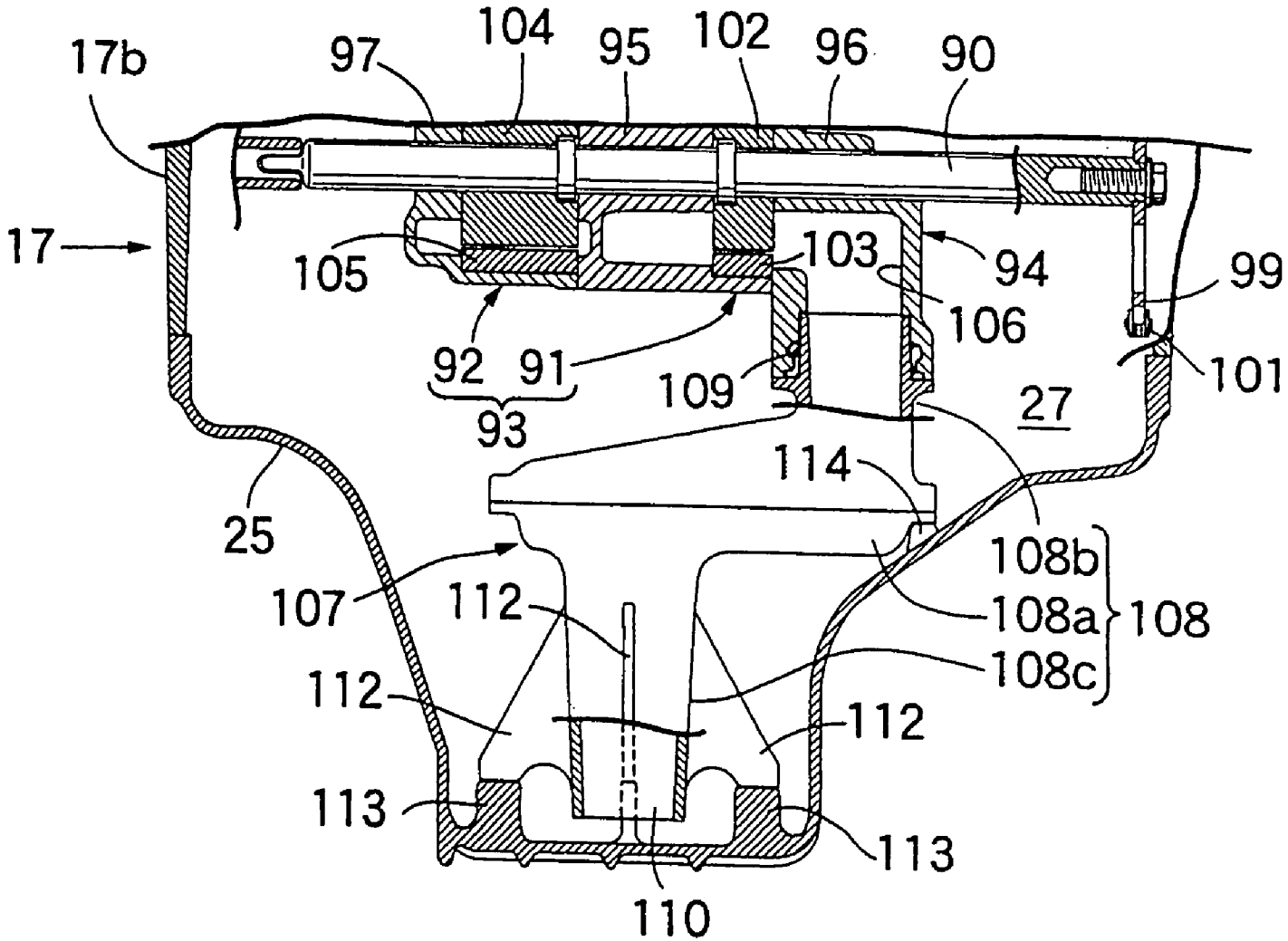
FIG. 13 is an enlarged sectional view along line 13—13 of FIG. 1.

Meanwhile, as shown in FIG. 13, the oil pan 25 is formed in a roughly V shape narrowed on the lower side as viewed from the rear side in the running direction of the motorcycle, and the casing 108 of the oil strainer 107 is formed in such a shape that, as viewed from the rear side in the running direction of the motorcycle, the casing main portion 108*a* and the connection pipe portion 108*b* are located near a right-side support wall of the oil pan 25, and the suction pipe portion 108*c* is located roughly at the center in the left-right direction of the oil pan 25.

A plurality of, for example four, strainer support portions 112, 112 . . . formed in a plate-like shape elongate vertically and with the projection amount from the casing 108 increased as one goes downwards are integrally formed on a side surface of the suction pipe portion 108*c* in a lower portion of the casing 108. The strainer support portions 112, 112 . . . abut on and are supported by support projected portions 113, 113 . . . provided at a bottom portion of the oil pan 25.

Moreover, the strainer support portions 112, 112 . . . are disposed on the left and right sides of the suction pipe portion 108*c* and are disposed on the front and rear sides of the suction pipe portion 108*c* so as to be orthogonal to the running direction of the motorcycle.

In addition, a support projected portion 114 abutting on a right side lower portion of the casing main portion 108*a* of the casing 108 is provided projectingly on and integrally with the right side wall of the oil pan 25.

Figure 14:
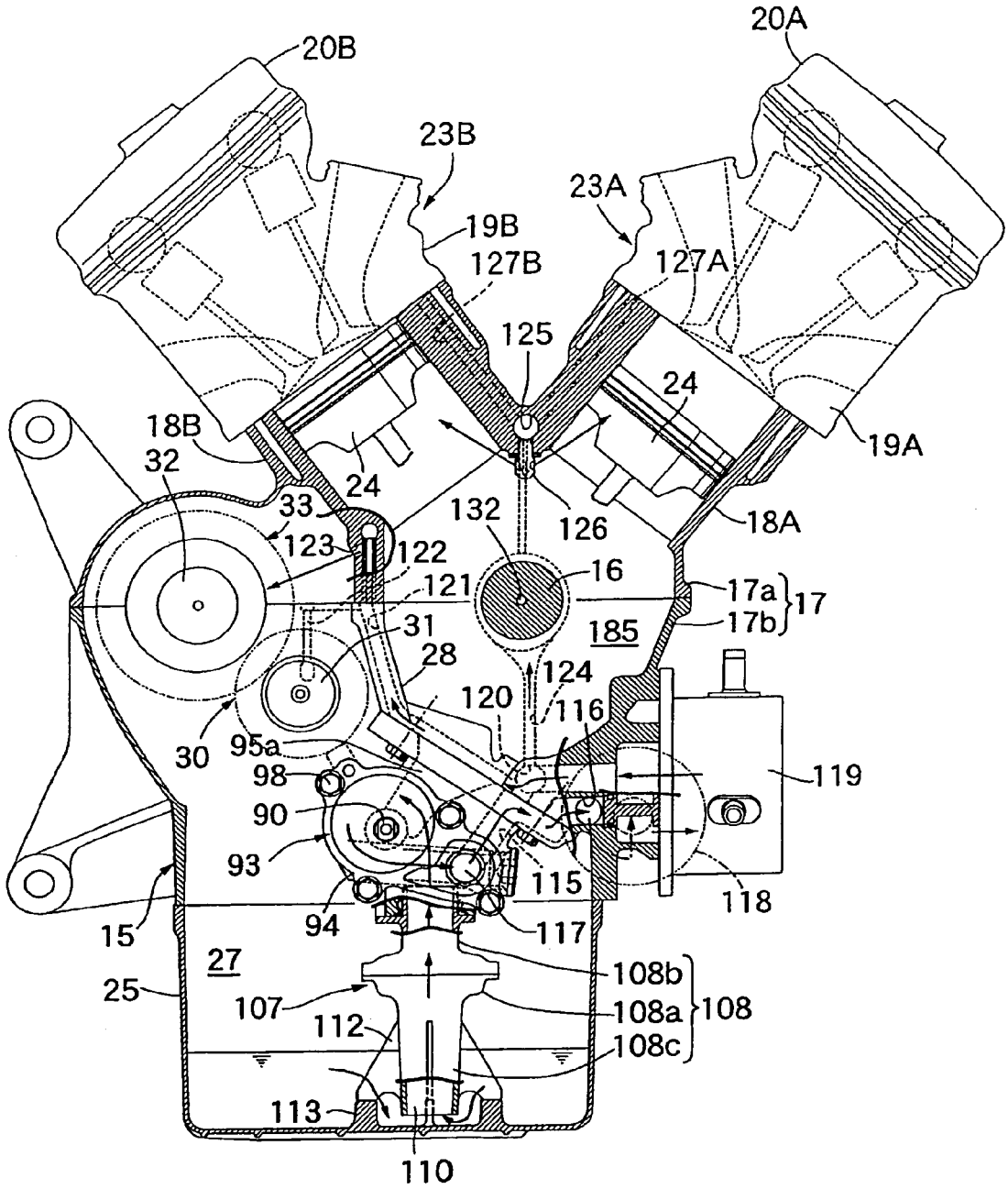
FIG. 14 is a vertical sectional view of an engine main body as viewed from the same direction as in FIG. 1, for showing the flow of oil by a feed pump.
Figure 15:
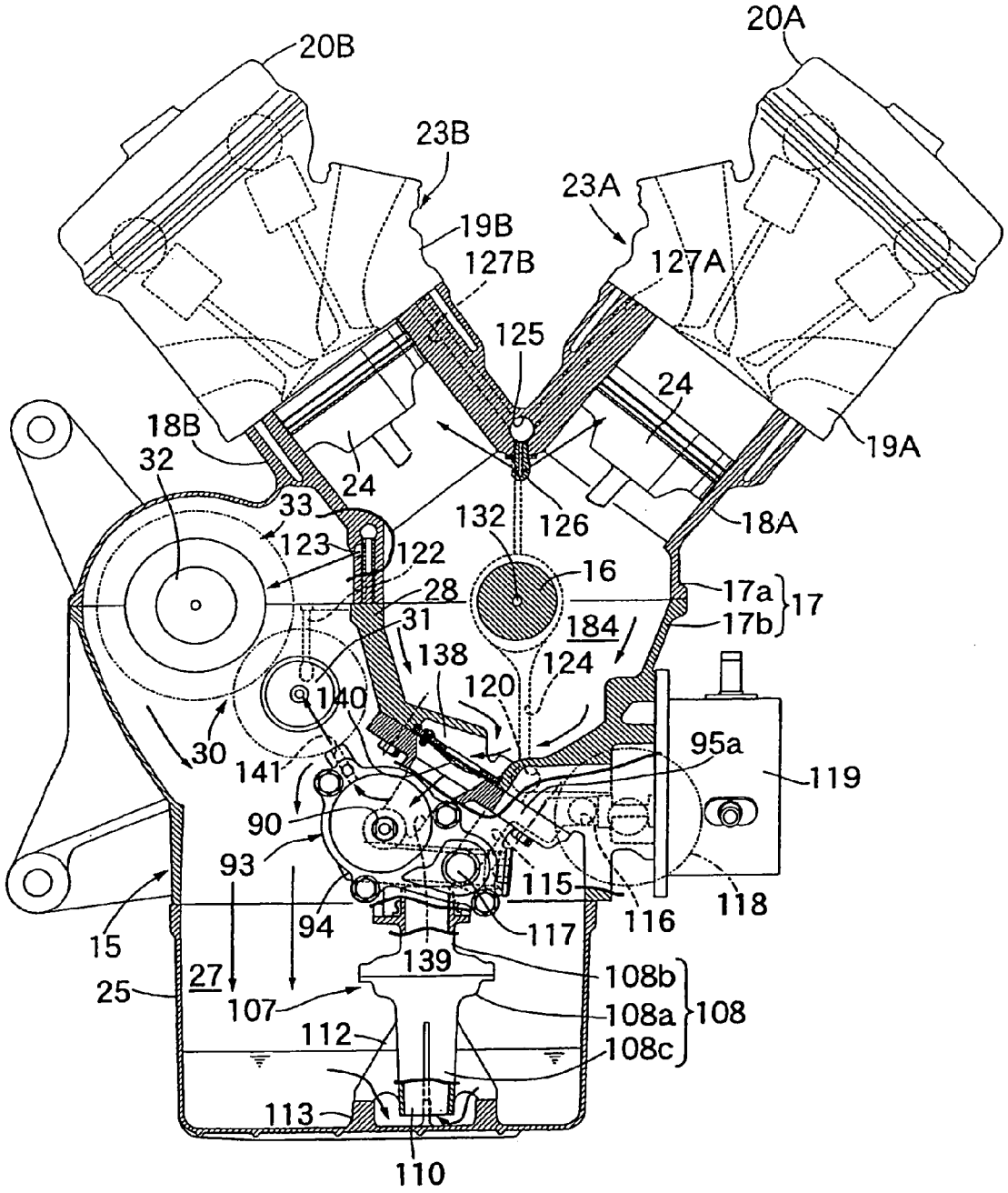
FIG. 15 is a vertical sectional view of the engine main body, corresponding to FIG. 14, for showing the flow of the oil by a scavenging pump.

With reference to FIGS. 14 and 15, the housing main body 95 of the pump housing 94 is provided with a discharge passage 115 for discharging the oil from the feed pump 91, and the discharge passage 115 is communicated with an oil passage 116 provided in the partition wall 28 of the crankcase 17. In addition, a relief valve 117 having an axis parallel to the oil pump shaft 90 is mounted between the casing main body 95 and the first cover 96 of the pump housing 94 so as to be opened, thereby relieving part of the oil flowing in the discharge passage 115 to the suction side of the feed pump 91, when the discharge pressure inside the discharge passage 115 reaches or exceeds a predetermined value.

The oil flowing through the oil passage 116 provided in the partition wall 28 is cleaned while passing through an oil filter 118 attached to the crankcase 17, as indicated by arrow in FIG. 14, and is then introduced into an oil cooler 119 attached to the crankcase 17, to be cooled.

The partition wall 28 is provided with a main gallery 120 extending in parallel to the crankshaft 16, and the oil guided from the oil cooler 119 to the main gallery 120 is branched into two portions. The oil on one side is led into an oil passage 121 provided in the partition wall 28, passes through an oil passage 122 to be supplied to the bearing portions for lubricating the first-speed to sixth-speed gear trains G1–G6 on the main shaft 31 and the counter shaft 32 in the gear transmission 30, and is jetted toward the gear transmission 30 from a nozzle 123 provided in the crankcase 17 so as to front on an upper portion of the transmission 27.

The oil on the other side upon branching from the main gallery 12 is fed upwards through a plurality of oil passages 124 . . . provided in the crankcase 17, to be used for lubricating a plurality of bearing portions for bearing the crankshaft 16. The oil passages 124 . . . are communicated with an upper oil gallery 125 provided at an upper portion of the crankcase 17 so as to extend in parallel to the crankshaft 16 at a portion adjacent to both banks 23A and 23B, and the oil is jetted toward the pistons 24 . . . in both banks 23A and 23B from nozzles 126 . . . connected to the upper oil gallery 125. The cylinder blocks 18A, 18B and the cylinder heads 19A, 19B of the first and second banks 23A and 23B are provided with oil passages 127A and 127B for leading the oil from the upper gallery 125 to the side of valve-operating mechanisms disposed between the cylinder heads 19A, 19B and the head covers 20A, 20B.

Further, as clearly shown in FIG. 8, a tubular portion 128 projecting to the crankshaft 16 side is integrally provided on the inside surface of the right cover 76 at a portion corresponding to the other end portion of the crankshaft 16. A bolt 129 having a hollow cylindrical portion 129*a* projecting into the tubular portion 128 is coaxially screw engaged with one end portion of the crankshaft 16, and an annular seal member 130 is interposed between the tubular portion 128 and the hollow cylindrical portion 129*a*. An oil chamber 131 sealed by the seal member 130 is formed inside the tubular portion 128 so that an end portion of the hollow cylindrical portion 129*a* fronts thereon, and the oil from the main gallery 120 is supplied into the oil chamber 131 through an oil passage (not shown).

Moreover, the bolt 129 is coaxially provided with a communication passage 133 for communicating an internal oil passage 132 provided in the inside of the crankshaft 16 to the oil chamber 131, and the oil led into the internal oil passage 132 is served to lubricate between the crankpins 16*a* . . . possessed by the crankshaft 16 and large end portions of the connecting rods 29. . . .

Referring to FIG. 15, the partition wall 28 is provided in its lower portion with an oil collection hole 138 for collecting the oil dropped to a lower portion of the inside of the crank chambers so as to be communicated with lower portions of the first to third crank chambers 183, 184 and 185. On the other hand, the housing main body 95 integrally having the mount portion 95*a* mounted to the partition wall 28 of the pump housing 94, is provided with a suction passage 139 for sucking the oil into the scavenging pump 92, correspondingly to the oil collection hole 138.

Moreover, a reed valve 140 for permitting only the flow of the oil into the suction passage 139 provided in the housing main body 95 through the oil collection hole 138 is disposed between the oil collection hole 138, which is communicated with the second crank chamber 184 corresponding to the cylinder at the center in the cylinder array direction in the first bank 23A, and the suction passage 139.

In addition, the second cover 96 of the pump housing 94 is provided with a discharge passage 141 for leading the oil discharged from the scavenging pump 92, and the discharge passage 141 is formed in the second cover 96 so that the oil is discharged from the downstream end thereof toward the gear transmission 30 side.

Figure 12:
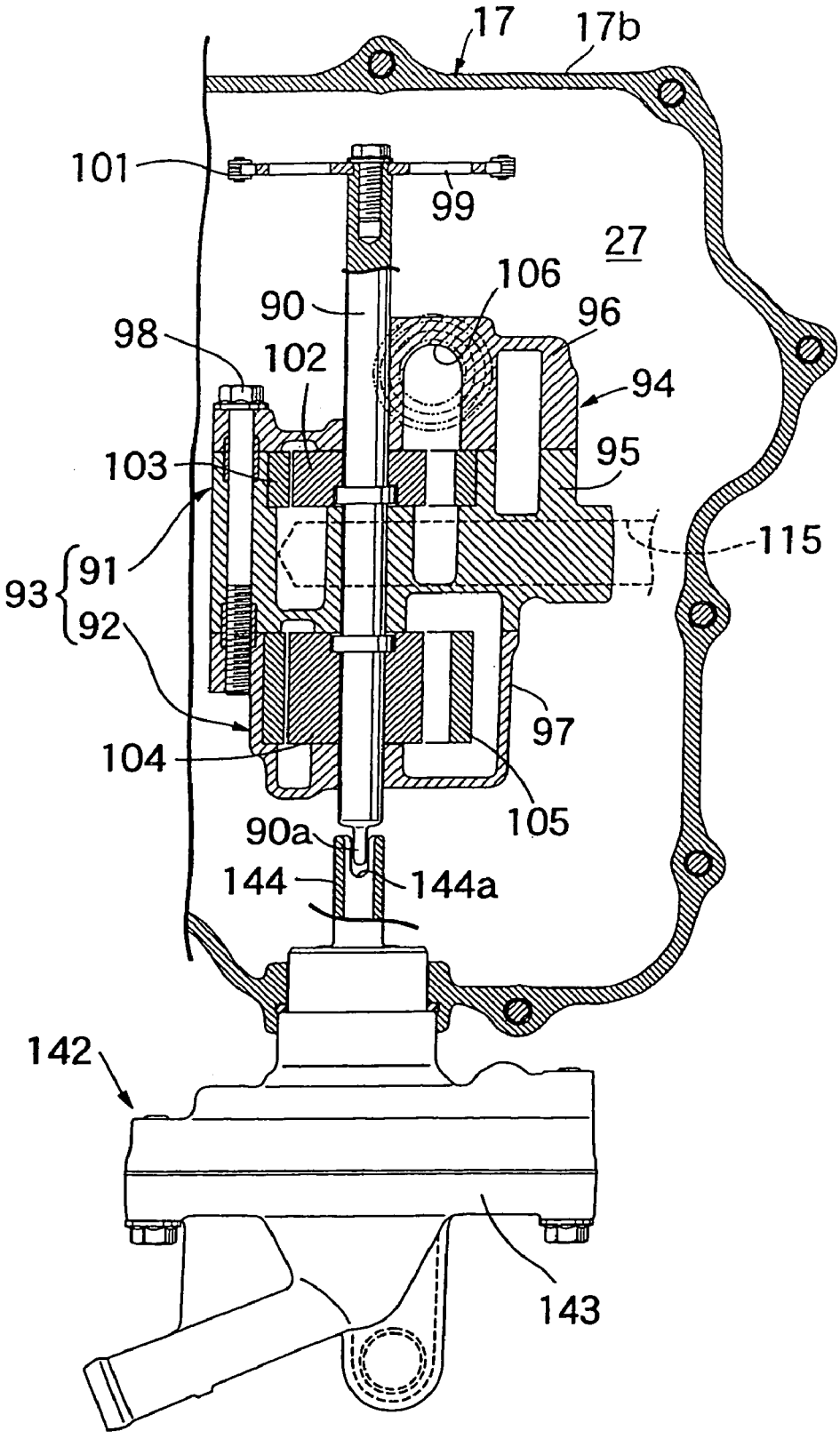
FIG. 12 is an enlarged sectional view along line 12—12 of FIG. 1.

With reference to FIG. 12, a pump case 143 of a water pump 142 is mounted to a left side support wall of the crankcase 17 at a portion corresponding to the pump unit 93, and a water pump shaft 144 provided in the water pump 142 so that its one end protrudes from the pump case 143 is disposed coaxially with the oil pump shaft 90 of the pump unit 93. Moreover, a projected portion 90*a* projectingly provided on the other end of the oil pump 90 is disengageably engaged with an engaging recessed portion 144*a* provided in one end of the water pump shaft 144. Namely, the feed pump 91 and the scavenging pump 92 in the pump unit 93 are driven by the motive power transmitted from the main shaft 31, and the water pump 142 is also driven by the motive power transmitted from the main shaft 31.

Moreover, as shown in FIG. 1, the oil pump 93 is disposed between a vertical plane P1 passing through the axis of the crankshaft 16 and a vertical plane P2 passing through the axis of the main shaft 31. On the opposite side of the oil pump 93 with respect to the vertical plane P2 passing through the axis of the main shaft 31, the shift drum 39 is disposed so as to constitute a part of the gear transmission 30, and the oil pump 93 and the shift drum 39 are disposed in the surroundings of the main shaft 31.

Now, functions of the described engine will be described below. The intake-side and exhaust-side camshafts 56A and 56B for driving (opening and closing) the intake valves 51A . . . and the exhaust valves 52A . . . in the first bank 23A are provided with the intake-side and exhaust-side driven sprockets 59A and 60A, and the endless form cam chain 62A is wrapped around the first bank drive sprocket 61A rotated together with the idle gear 65 supplied with motive power from the crankshaft 16 and around the intake-side and exhaust-side camshafts 56A and 58A.

The intake-side and exhaust-side camshafts 56B and 58B for driving (opening and closing) the intake valves 51B . . . and the exhaust valves 52B . . . in the second bank 23B are provided with the intake-side and exhaust-side driven sprockets 59B and 60B, and the endless form cam chain 62B is wrapped around the second bank drive sprocket 61B rotated together with the idle gear 65 and around the intake-side and exhaust-side camshafts 56B and 58B.

The crankshaft 16 is provided with the primary drive gear 41 for transmitting the motive power of the engine to the gear transmission 30 side, and the idler drive gear 64 which is smaller in diameter than the primary drive gear 41 and which is disposed on the outer side in the axial direction relative to the primary drive gear 42. The idle gear 65 meshed with the idler drive gear 64 is rotatably borne on the idle shaft 66 supported on the crankcase 17 of the engine main body 15, with its axis parallel to the crankshaft 16. The first and second bank drive sprockets 61A and 61B are provided on the inner side in the axial direction of the idle gear 65 coaxially with and adjacently to the idle gear 65 so that at least parts of their outer peripheries are opposed to the primary drive gear 41.

Specifically, the idle gear 65 is meshed with the idler drive gear 64 provided on the crankshaft 16 while being smaller in diameter than the primary drive gear 41 having a comparatively large diameter, and the first and second bank drive sprockets 61A and 61B are provided on the inner side in the axial direction of the idle gear 65 coaxially with and adjacently to the idle gear 65, with at least parts of their outer peripheries opposed to the primary drive gear 64. Therefore, it is possible to reduce the interval between the axes of the crankshaft 16 and the idle shaft 66, thereby contributing to a reduction in the size of the V-type engine.

In addition, the primary driven gear 42 with which the primary drive gear 41 is meshed is connected to the clutch 34 interposed between the crankshaft 16 and the gear transmission 30 while being disposed at a position opposed to the outer periphery of the idler drive gear 64. Therefore, it is possible to lay out the crankshaft 16 and the clutch 34 close to the crankshaft 16 side, and to reduce the distance between the axes of the clutch 34 and the crankshaft 16, thereby further contributing to a reduction in the size of the V-type engine.

Further, the first bank drive sprocket 61A, the intake-side driven sprocket 59A, the exhaust-side driven sprocket 60A and the cam chain 62A on the first bank 23A side, and the second bank drive sprocket 61B, the intake-side driven sprocket 59B, the exhaust-side driven sprocket 60B and the cam chain 62B on the side of the second bank 23B forming a V shape together with the first bank 23A, are disposed adjacently on one side in the axial direction of the crankshaft 16. The first and second bank drive sprockets 61A and 61B are formed integral with the single idle gear 65 common for both the drive sprockets 61A and 61B. Therefore, it is possible to contribute to a reduction in the size of the V-type engine in a direction along the axis of the crankshaft 16, and to achieve a reduction in the number of component parts of the engine.

Further, the idle shaft 66 having the eccentric shaft portion 66*a* is supported on the crankcase 17 so that its position about the axis set off from the axis of the eccentric shaft portion 66*a* can be regulated, and the idle gear 65 is rotatably borne on the eccentric shaft portion 66*a* through the needle bearings 67. . . . Therefore, it is possible, while enabling a reduction of the backlash between the idler drive gear 64 and the idle gear 65 by regulating the rotational axis of the idle gear 65, to prevent the first and second bank drive sprockets 61A and 61B and the idle gear 65 from being increased in diameter, and to further reduce the distance between the axes of the idle shaft 66 and the crankshaft 16.

In addition, in the first and second banks 23A and 23B, the tensioner lifters 83A and 83B are set to abut on the chain tensioner 81A and 81B, with which the cam chains 62A and 62B make sliding contact, from the opposite side of the cam chains 62A and 62B, and the tensioner lifters 83A and 83B are provided in the first and second cylinder heads 19A and 19B of the first and second banks 23A and 23B. One or both tensioner lifters 83A and 83B (in this embodiment, the tensioner lifter 83A in the first bank 23A located on the front side in the running direction of the motorcycle), of both banks 23A and 23B, is provided in the first cylinder head 19A at a portion corresponding to the outside of both banks 23A and 23B, and the other tensioner lifter 23B is provided in the second cylinder head 19B at a portion corresponding to the inside of both banks 23A and 23B. In addition, the distance LA from the top connection surface 22A of the first cylinder head 19A to the one tensioner lifter 83A is set to be smaller than the distance LB from the top connection surface 22B of the second cylinder head 19B to the other tensioner lifter 83B.

Therefore, the tensioner lifter 83B provided in the second cylinder head 19B at a portion corresponding to the inside of both banks 23A and 23B can be disposed at a position as low as possible, whereby the dead space between both banks 23A and 23B can be reduced.

Since the projected portion of the other tensioner lifter 83B projected from the second cylinder head 19B is disposed slantly so as to approach the top connection surface 22B of the second cylinder head 19B, it is possible to further reduce the dead space between both banks 23A and 23B, to facilitate the mounting of the tensioner lifter 83B onto the second cylinder head 19B from the upper side, and to enhance mountability.

Furthermore, since the projected portion of the one tensioner lifter 83A projected from the first cylinder head 19A is disposed slantly so as to space away from the top connection surface 22A of the first cylinder head 19A, it is possible to restrain the projection of the tensioner lifter 83A disposed on the outside of both banks 23A and 23B from the first cylinder head 19A, thereby contributing to a reduction in the size of the engine, and to secure the space for laying out accessories which are laid out in the surroundings of the engine.

In the power transmission means 50A of the first bank 23A, the end portion 204 on the first bank drive sprocket 61A side of the chain guide member 80A is so formed as to cover from outside at least a part of the portion, around which the cam chain 62A is wrapped, of the outer periphery of the first bank drive sprocket 61A. Therefore, it is possible to restrain the cam chain 62A from chattering at its portion wrapped around the first bank drive sprocket 61A, and to stably guide the cam chain 62A by the chain guide member 80A. Moreover, the end portion 204 of the chain guide member 80A can maintain the wrapped condition of the cam chain 62A around the first bank drive sprocket 61A so as to prevent the cam chain 62A from slipping off from the first bank drive sprocket 61A at the time of mounting, whereby enhancement of mountability can be achieved.

Moreover, the chain guide member 80A in the power transmission means 50A of the first bank 23A constituting one of the first and second banks 23A and 23B arranged in a V shape is configured as above-mentioned. Therefore, even in the V-type engine in which the cam chains 62A and 62B are liable to chatter because the cam chains 62A and 62B are wrapped respectively around the first and second bank drive sprockets 61A and 61B disposed coaxially in correspondence with the first and second banks 23A and 23B, it is possible at least to restrain the cam chain 62A from chattering at its portion wrapped around the first bank drive sprocket 61A, and to enhance mountability.

In addition, since the end portion 204 on the first bank drive sprocket 61A side of the chain guide member 80A is so formed as to extend around to the lower side of the first bank drive sprocket 61A, the cam chain 62A can be covered by the end portion 204 of the chain guide member 80A over a wider range at its portion wrapped around the first bank drive sprocket 61A. Moreover, since the end portion 204 of the chain guide member 80A is supported by both the support boss 78 provided in the crankcase 17 of the engine main body 15 in the vicinity of the first bank drive sprocket 61A and the hollow cylindrical portion 68*c* of the shaft holder 68 fastened to the support boss 78 by the bolt 69, it is possible to restrain more effectively the cam chain 62A from chattering at its portion wrapped around the first bank drive sprocket 61A.

In addition, in the power transmission means 50A of the first bank 23A, since the end portion 204 of the chain guide member 80A is so formed as to extend around to the lower side of the first bank drive sprocket 61A in the manner of being astride the cam chain 62B of the power transmission means 50B of the second bank 23B, it is possible, even in the V-type engine, to restrain more effectively the cam chain 62A from chattering at its portion wrapped around the first bank drive sprocket 61A.

Besides, since the end portion 204 of the chain guide member 80A in the power transmission means 50A on the first bank 23A side and the support portion 205 provided in the chain guide member 80B of the power transmission means 50B on the second bank 23B side are laid on each other and supported by the support boss 78 and the hollow cylindrical portion 68*c* of the shaft holder 68, it is possible to reduce the number of component parts, and to facilitate mounting and dismounting of the chain guides 80A and 80B in both banks 23A and 23B at the time of mounting or at the time of disassembly for maintenance or the like, leading to labor saving.

Furthermore, since the first and second bank drive sprockets 61A and 61B are provided on the idle gear 65 having an axis parallel to the crankshaft 16 and operated in conjunction with the crankshaft 16, it is possible, by laying out the idle gear 65 in a location rich in spatial allowance, to freely set the shapes of the chain guide members 80A and 80B without being influenced by the layout. Moreover, as compared with the case where the drive sprockets are provided on the crankshaft 16, it is possible to reduce the size of the drive sprockets 61A and 61B, and to cover the portion wrapped around the first bank drive sprocket 61A of the cam chain 62A while obviating an increase in the size of the end portion on the first bank drive sprocket 61A side of the chain guide member 80A.

In addition, the oil pan 25 for reserving the oil to be supplied to portions of the engine main body 15 is provided at a lower portion of the crankcase 17, an upper end portion of the casing 108 of the oil strainer 107 disposed in the oil pan 25 is supported on the crankcase 17 side, and the casing 108 with its lower end portion formed in a funnel-like shape is provided with the suction port 110 at its lower end. A plurality of strainer support portions 112 . . . in a plate-like shape elongate vertically are formed integrally with a lower side surface of the casing 108 of the oil strainer 107, and the strainer support portions 112 . . . abut on and are supported by the bottom portion of the oil pan 25.

Therefore, with the strainer support portions 112 . . . performing the function of reinforcement ribs, it is possible to enhance the strength of a lower portion of the casing 108, and to enhance the support strength for the oil strainer 107 while eliminating the need to enhance particularly the support strength on the crankcase 17 side for supporting the upper end portion of the oil strainer 107. Thus, the oil strainer 107 can be firmly supported while obviating increases in the size and weight of the engine and an increase in the number of component parts of the engine. Moreover, since the strainer support portions 112 . . . also function as partition walls for restricting the movements of the oil in the oil pan 25, the need to dispose a partition wall other than the oil strainer 107 in the oil pan 25 is eliminated, which also leads to a reduction in the number of component parts.

Since the strainer support portions 112 . . . are so formed that their projection amount from the casing 108 is increased as one goes downwards, it is possible to effectively rectify the flow of the oil in the vicinity of the suction port 110, to reduce the resistance against the suction of the oil into the suction port 110, and enhance the suction efficiency.

Moreover, since the strainer support portions 112 . . . are disposed in pairs in the front-rear direction and the left-right direction of the motorcycle, it is possible to effectively restrict the movement of the oil in the oil pan 25 attendant on a rapid acceleration or rapid deceleration of the motorcycle and the movement of the oil in the oil pan 25 attendant on the motorcycle's movement in the left-right direction.

Further, since the oil pan 25 is formed in a roughly V shape narrowed at the lower portion as viewed from the running direction of the motorcycle, it is possible to effectively prevent the oil from moving in the front-rear direction attendant on a rapid acceleration or rapid deceleration of the motorcycle, between both left and right side walls of the oil pan 25 being in the roughly V shape narrowed at the lower portion and the oil strainer 107.

Figure 16:
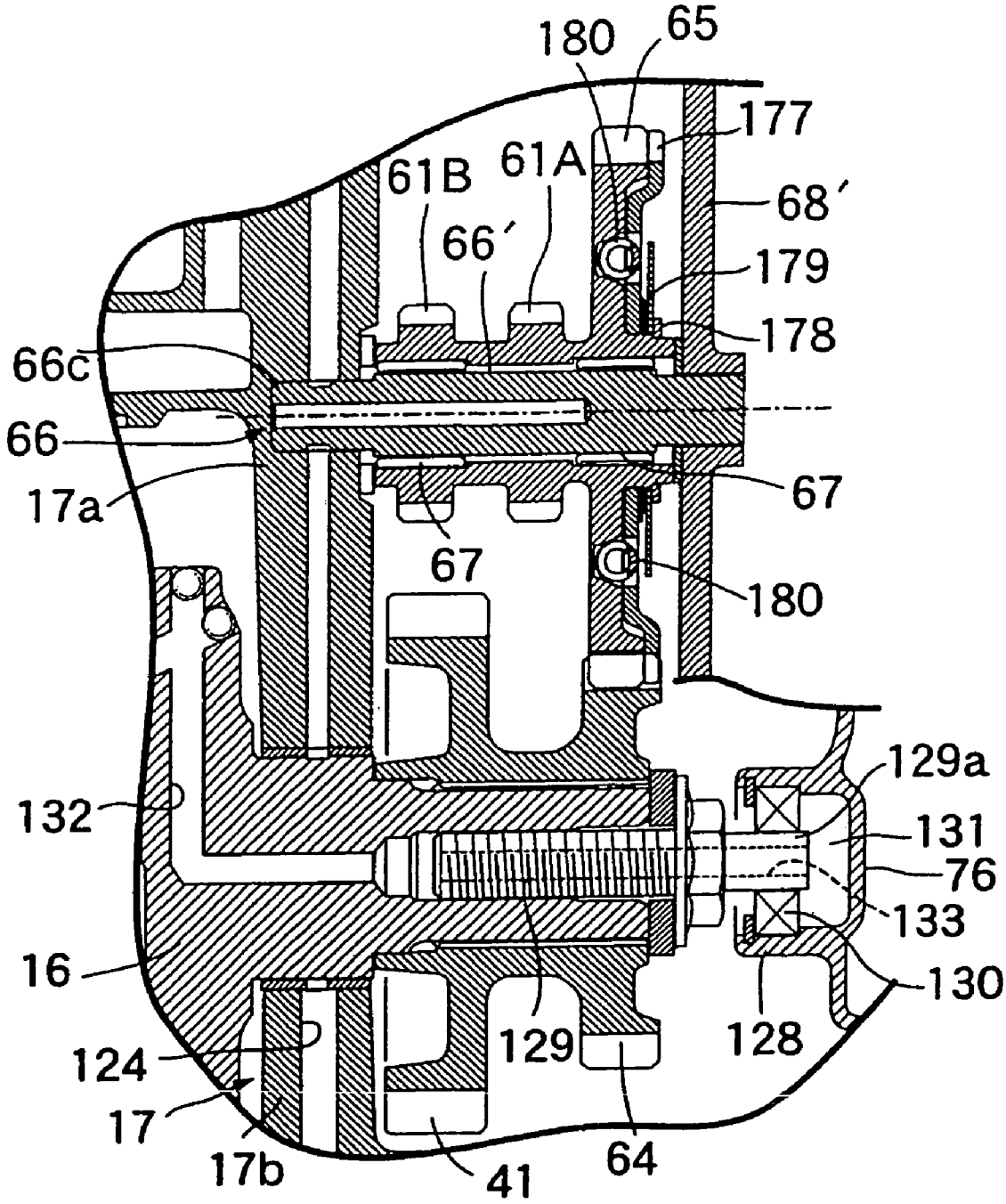
FIG. 16 is a sectional view, corresponding to FIG. 8, of a second embodiment.

FIG. 16 shows a second embodiment of the present invention, in which the portions corresponding to those in the first embodiment are shown and denoted by the same symbols as used above, and detailed description thereof is omitted.

In FIG. 16, the idle gear 65, the first bank side drive sprocket 61A and the second bank side drive sprocket 61B formed integrally are rotatably supported on an idle shaft 66' having no eccentric shaft portion through the needle bearings 67, 67, and both end portions of the idle shaft 66' are supported by a shaft holder 68' mounted to the crankcase 17 and the crankcase 17.

Moreover, on the side of the shaft holder 68', a sub-gear 177 rotatably borne on the idle shaft 66' is disposed adjacently to the idle gear 65, and a spring 179 for biasing the sub-gear 177 toward the idle gear 65 side is interposed between a stop ring 178 attached to the idle shaft 66' and the sub-gear 177. In addition, a plurality of coil springs 180, 180 . . . giving spring forces for relatively turning the gears 65 and 177 in one sense of the circumferential direction are interposed between the idle gear 65 and the sub-gear 177. The idle gear 65 and the sub-gear 177 are meshed with the idler driven gear 64.

In FIG. 16, since the first and second bank side drive sprockets 61A and 61B are formed integrally with the single idle gear 65, it is possible to contribute to a reduction in the size of the V-type engine in a direction along the axis of the crankshaft 16, and to achieve a reduction in the number of engine component parts.

In addition, it is possible to prevent the first and second bank side drive sprockets 61A and 61B and the idle gear 65 from being enlarged in size, and to further reduce the distance between the axes of the idle shaft 66' and the crankshaft 16, while enabling a reduction of the backlash between the idler drive gear 64 and the idle gear 65.

Meanwhile, the crankshaft 16 and the counter shaft 32 with parallel axes are rotatably borne between the connecting surfaces of the upper case 17*a* and the lower case 17*b* which are connected to each other so as to constitute the crankcase 17 of the engine main body 15, and the main shaft 31 between which and the counter shaft 32 there are interposed a plurality of speed change stages, for example, six stages of gear trains G1–G6 capable of being selectively established is rotatably borne on the left-side and right-side support walls 187 and 188 provided in the lower case 17*b* with an interval therebetween along the axis of the main shaft 31.

The left-side support wall 187 is provided with the first bearing hole 198 in which to fit and hold the needle bearing 197 mounted to one end of the main shaft 31, whereas the right-side support wall 188 is provided with the second bearing hole 199 for enabling submerging of the main shaft 31 from the other end side until one end of the main shaft 31 is fitted in the needle bearing 197 fitted and held in the first bearing hole 198. The ball bearing 200 is fitted and held in the second bearing hole 199 in such a manner that one end of the main shaft 31 is fitted in the first bearing hole 198 and thereafter the ball bearing 200 is fitted over the main shaft 31 from the other end side.

Therefore, the second bearing hole 199 can be provided with a diameter smaller than that of a through-hole conventionally provided in the right side support wall 188 while having a diameter greater than the maximum diameter among the plurality of main gears 191–196 provided on the main shaft 31. By this it is possible to reduce the distance between the axes of the crankshaft 16 and the main shaft 31, and to achieve a reduction in the size of the engine in a direction along the front-rear direction of the motorcycle. Moreover, as compared with a conventional configuration in which a bearing holder for bearing an intermediate portion of the main shaft 31 so as to close the through-hole is needed, the need for the bearing holder is eliminated and, therefore, it is possible to reduce the number of component parts, to eliminate the need to mount the bearing holder, and to thereby achieve a reduction in the number of mounting steps.

In addition, the shift drum 39 and the oil pump 93 are laid out in the surroundings of the main shaft 31, the distance between the shift drum 39 and the oil pump 93 and the main shaft 31 can be reduced, and the engine can be further reduced in size.

Moreover, since the oil pump 93 is disposed between the vertical planes P1 and P2 passing respectively through the axes of the crankshaft 16 and the main shaft 31, so as to be operated in conjunction with the main shaft 31, the oil pump 93 can be disposed by utilizing the space generated between the crankshaft 16 and the main shaft 31. In addition, by disposing the oil pump 93 close to the main shaft 31 for driving the oil pump 93, the motive power transmission mechanism between the main shaft 31 and the oil pump 93 can be made compact by, for example, using the pump drive sprocket 100, the pump driven sprocket 99 and the chain 101.

Further, the upper case 17*a* of the crankcase 17 has a ceiling wall portion 179 for covering the counter shaft 32 from the upper side. In this case, since the ceiling wall portion 179 is provided adjacently to the cylinder block 18B at an intermediate portion in the sliding direction of the sliding of the cylinder block 18A relative to the piston 24, the counter shaft 32 can be disposed close to the cylinder block 18B of the second bank 23B, which can further reduce the size of the engine along the front-rear direction of the motorcycle, and the engine can be further reduced in size along the front-rear direction of the motorcycle.

While a number of embodiments of the present invention have been described above, the invention is not limited to the above embodiments, and various design modifications are possible within the scope of the invention as set forth in the claims.

For example, while the case of using the idle gear 65 as a conjunction rotary member rotated in conjunction with the crankshaft 16 has been described in the above embodiment, a configuration may be adopted in which an idle shaft having an axis parallel to the crankshaft 16 is borne on the engine main body 15 so as to be rotated in conjunction with the crankshaft, and the first and second bank drive sprockets 61A and 61B are provided on the idle shaft.

The invention claimed is:

1. A cam drive gear for an engine, comprising an idle gear rotatably borne on an idle shaft supported on an engine main body so as to permit power to be transmitted from a crankshaft, drive sprockets rotatable together with said idle gear, driven sprockets provided on camshafts, and endless form power transmission members wrapped around said drive sprockets and said driven sprockets; a primary drive gear mounted on the crankshaft for transmitting the power of the engine to a transmission, and an idler drive gear having a diameter smaller than a diameter of said primary drive gear and disposed to an outer side of said primary drive gear in the axial direction, said idle gear is meshed with said idler drive gear and said idle shaft has an axis parallel to said crankshaft, and said drive sprockets have at least parts of outer peripheries thereof opposed to said primary drive gear and said drive sprockets are disposed to an inner side of said idle gear in the axial direction and said drive sprockets are coaxial with and adjacent to said idle gear.

2. The cam drive gear for an engine as set forth in claim 1, further comprising a primary driven gear meshable with said primary drive gear, said primary driven gear is connected to a clutch disposed at a position opposed to an outer periphery of said idler drive gear and interposed between said crankshaft and said transmission.

3. The cam drive gear for an engine as set forth in claim 1, wherein said drive sprockets, said driven sprockets and said power transmission members comprise a pair of banks that are arranged in a V-shape adjacent to a crankcase that rotatably supports said crankshaft thereon, and said banks are mutually adjacently disposed toward one end of said crankshaft in the axial direction, and said drive sprockets of both said banks are formed integral with said idle gear.

4. The cam drive gear for an engine as set forth in claim 3, further comprising a guide member making sliding contact with the outer periphery of a first one of said endless form power transmission members, said drive sprockets are arranged coaxially, and wherein an end portion of said guide member adjacent one of said drive sprockets is so formed as to cover at least a portion of the outer periphery of said one drive sprocket around which said first endless form power transmission member is wrapped.

5. The cam drive gear for an engine as set forth in claim 4, wherein said end portion of said guide member is so formed as to extend around to a lower side of said one drive sprocket and is astride said endless form power transmission member of the other bank and is supported by a support member fastened to the engine main body.

6. The cam drive gear for an engine as set forth in claim 5, wherein said end portion of said guide member and a support portion connected to a guide member of the other of said banks are laid on each other and are supported by said support member and a support boss provided on said engine main body for fastening said support member.

7. The cam drive gear for an engine as set forth in claim 1, wherein said idle shaft has an eccentric shaft portion, and said idle shaft is supported on said engine main body so as to permit regulation of the position of said idle shaft about an axis set off from an axis of said eccentric shaft portion, and said idle gear is rotatably borne on said eccentric shaft portion through a needle bearing.

8. The cam drive gear for an engine as set forth in claim 1, further comprising a guide member making sliding contact with the outer periphery of a first one of said endless form power transmission members, wherein an end portion of said guide member adjacent one of said drive sprockets is so formed as to cover at least a portion of the outer periphery of said one drive sprocket around which said first endless form power transmission member is wrapped.

9. The cam drive gear for an engine as set forth in claim 8, wherein said end portion of said guide member is so formed as to extend around to a lower side of said one drive sprocket and is supported by a support member fastened to the engine main body.

10. A valve-operating system drive gear for an engine, comprising first and second power transmission means each comprising a driven sprocket provided on a camshaft that is rotatably borne on a cylinder head a drive sprocket operated in conjunction with the rotation of a crankshaft an endless form cam chain wrapped around said drive sprocket and said driven sprocket, and a chain guide member making sliding contact with the outer periphery of said cam chain; the first and second power transmission means being disposed respectively in first and second banks arranged in a V shape, said drive sprockets in both said banks being aranged coaxially, wherein in said power transmission means on at least one side of said first and second banks, an end portion of said chain guide member adjacent said drive sprocket is so formed as to cover at least a portion of the outer periphery of said drive sprocket around which said cam chain is wrapped;

said end portion of said chain guide member being formed as to extend around to a lower side of said drive sprocket of said power transmission means of said one bank and is astride said cam chain of said power transmission means of the other bank and is supported by a support member fastened to an engine main body that includes said cylinder heads; and said end portion of said chain guide member and a support portion connected to said chain guide member of said power transmission means of the other of said banks being laid on each other and being supported by said support member and a support boss provided on said engine main body for fastening said support member.

11. A valve-operating system drive gear for an engine as set forth in claim 10, wherein said drive sprockets are disposed adjacent a rotary member having an axis parallel to said crankshaft and which is rotated in conjunction with said crankshaft.

* * * * *